US007461599B2

(12) United States Patent
Hachikawa

(10) Patent No.: US 7,461,599 B2
(45) Date of Patent: Dec. 9, 2008

(54) DERAILMENT PROTECTION APPARATUS

(76) Inventor: Masato Hachikawa, Imai Bld. 6F, 7-10, 1 Chome, Yaesu, Chuoku, 103-0028, Tokyo (JP)

( * ) Notice: Subject to any disclaimer, the term of this patent is extended or adjusted under 35 U.S.C. 154(b) by 369 days.

(21) Appl. No.: 11/295,401

(22) Filed: Dec. 7, 2005

(65) Prior Publication Data

US 2006/0124024 A1 Jun. 15, 2006

(30) Foreign Application Priority Data

Dec. 14, 2004 (JP) ..... 2004-382539

(51) Int. Cl.
*B61F 9/00* (2006.01)

(52) U.S. Cl. ..... 104/242; 104/243; 105/215.1

(58) Field of Classification Search ..... 104/242, 104/243, 247; 105/215.1, 216, 217; 295/9.1
See application file for complete search history.

(56) References Cited

U.S. PATENT DOCUMENTS

| | | | | | |
|---|---|---|---|---|---|
| 777,190 | A * | 12/1904 | Edwards | ..... | 105/216 |
| 943,665 | A * | 12/1909 | Edwards | ..... | 104/242 |
| 2,431,062 | A * | 11/1947 | McCormick et al. | ..... | 104/242 |
| 3,831,527 | A * | 8/1974 | Peterson | ..... | 105/215.1 |
| 4,305,336 | A * | 12/1981 | Hunsberger et al. | ..... | 105/215.1 |
| 5,188,038 | A * | 2/1993 | Shanley | ..... | 105/216 |
| 6,860,453 | B2 * | 3/2005 | Moretti et al. | ..... | 246/169 R |

* cited by examiner

*Primary Examiner*—Lars A Olson

(57) ABSTRACT

The disclosed is a derailment protection apparatus that may comprise a wheel guiding member or a rail contact member having an inclined surface, a descending device to descend the wheel guiding member or the rail contact member, and wherein the inclined surface comes in contact with a rail, when the descending device operates. The derailment protection apparatus may return a wheel of a rolling stock to be deviated from a rail to a normal position, when the rolling stock with a bogie receives an abnormal vibration due to such as earthquake.

26 Claims, 34 Drawing Sheets

DERAILMENT PROTECTION APPARATUS

CROSS-REFERENCE TO RELATED APPLICATIONS

This application claims the benefit of the prior foreign application: Japanese Patent Application No. 2004-382539 filed on Dec. 14, 2004 in the Japan Patent Office and Japanese Patent Application No. 2005-379886 filed on Nov. 30, 2005 in the Japan Patent Office. The entire disclosures of which are incorporated herein by reference in this application.

BACKGROUND OF THE INVENTION

1. Field of the Invention

The present invention relates to a novel derailment protection apparatus that prevents a railway car (i.e. railroad car) or rolling stock under running state from a derailment.

2. Description of Related Art

Some derailment protection apparatuses are disclosed in patent documents, for example, Japanese patent application publications laid-open No. 09-272436 (patent document No. 1) and No. 2002-79941 (patent document No. 2).

The patent document No. 1, entitled "Derailment Preventing Device for truck" discloses that T type or I type retaining metals are attached to the wheel mount of a truck (rolling stock). One-side opened angular receiving metals are attached to the flange part of the truck main body.

By pinching the retaining metals on the wheel side by means of the retaining metals on the truck main body side, the retaining metals on the wheel side hit the retaining metals on the truck main body side, when a wheel swings to left and right relative to the progressing direction of the truck so as to correct the track automatically by the wheels themselves to make further running. In this case, a shock absorber provided on the inner surfaces of the receiving metals are hit by the retaining metals and on account of that repelling force, the wheels are changed in their mutually opposing directions and by repeating this action, track correction can be carried out automatically by the wheels themselves.

The patent document No. 2, entitled "Rolling Stock" discloses that a body is supported on a truck frame, axles and the wheels support the truck frame, and axle box suspensions support the axles by means of coil springs or rubber. Vertical load detectors are used between the axle box suspensions and the truck frame to detect vertical load. A comparison operator is used to perform comparative operation on detected results of the vertical load detectors, and an alarm is operated according to a detected result of the comparison operator. Thus, speed of the rolling stock is reduced, and the rolling stock is brought to an emergency stop.

In the derailment preventing device for truck (or derailment prevention apparatus) disclosed in the patent document No. 1, the retaining metals are attached to the wheel mount of a truck (rolling stock). One-side opened angular receiving metals are attached to the flange part of the truck main body. And the retaining metals and the receiving metals are fixed to the rolling stock, During the rolling stock runs on a track with curved rails, the retaining metals and the receiving metals always hit together because the rolling stock receives a large lateral vibration.

Therefore, this derailment preventing device can not used in general rolling stock or train to run with comparatively high speed.

Furthermore, this derailment preventing device can not detect vertical and/or horizontal vibrations due to earthquake.

In the patent document No. 1, the vertical load detectors detect abnormal vibrations and the comparison operator performs comparative operation on detected results of the vertical load detectors. When the rolling stock receives the abnormal vibrations, the alarm is operated for indicating a command to reduce speed of the rolling stock is reduced or stop the rolling stock.

However, this device itself does not protect a derailment of the rolling stock.

BRIEF SUMMARY OF THE INVENTION

A purpose of the present invention is to propose a novel derailment protection apparatus.

The derailment protection apparatus of the present invention may return a wheel of a rolling stock to be deviated from a rail to a normal position, when the rolling stock with a bogie during running receives an abnormal vibration due to such as earthquake.

One aspect of the present invention is a derailment protection apparatus that may comprise a wheel guiding member (or a rail contact member) having an inclined surface, a descending device to descend the wheel guiding member (or the rail contact member), and wherein the inclined surface comes in contact with a rail, when the descending device operates.

The derailment protection apparatus may further comprise an abnormal vibration detecting device to detect an abnormal vibration; and wherein the descending device is activated when the abnormal vibration detecting device detects the abnormal vibration.

The descending device may be controlled by a human judgment typically a driver or a conductor.

Another aspect of the present invention is a derailment protection apparatus that may comprise a derailment protection apparatus composed of an abnormal vibration responsive device to detect an abnormal vibration more than a predetermined allowable range, a wheel guiding device having a wheel guiding member (or a rail contact member) with an inclined surface, and wherein the inclined surface is descended to a functioning position to come in contact with a rail and the inclined surface guides a wheel to return on the rail.

In one embodiment of the derailment protection apparatus, the wheel guiding device is composed of a rotary member having a rotary axis fixed on a bogie, a support member fixed on the rotary member elongated to the wheel guiding member, a rod-like member connected to the rotary member and elongated to a flexible joint member, and wherein the rotary member rotates in an abnormal state so that the wheel guiding member is descended to the functioning position.

In another embodiment of the derailment protection apparatus, the wheel guiding device is composed of a fluidic cylinder fixed on a bogie having a shaft actuated by compressed fluid, a compressed fluid tank fixed on the bogie to supply the compressed fluid to the fluidic cylinder, and wherein the wheel guiding member (or the rail contact member) is fixed on a bottom end of the shaft.

In a still another embodiment of the derailment protection apparatus, the wheel guiding device is composed of a cylindrical member, a tubular member fixed on a bogie movably guides the cylindrical member, a coil spring positioned around the cylindrical member; and at least one lock device to lock the cylindrical member to keep an upper position, wherein the wheel guiding member (or the rail contact member) is fixed to a lower portion of the cylindrical member, and wherein, in an abnormal state, the lock device releases the cylindrical member to descend the cylindrical member.

In other embodiment of the derailment protection apparatus, the wheel guiding device is composed of a gas cylinder fixed on a bogie having a movable shaft and an explosive enclosed in the gas cylinder, wherein the wheel guiding member is fixed to a lower terminal of the movable shaft, and wherein the movable shaft is descended by an explosion of the explosive.

BRIEF DESCRIPTION OF THE SEVERAL VIEWS OF THE DRAWING

For a more complete understanding of the present invention and the advantage thereof, reference is now made to the following descriptions taken in conjunction with the accompanying drawings, in which.

REFERENCE NUMERALS

Figure 1:
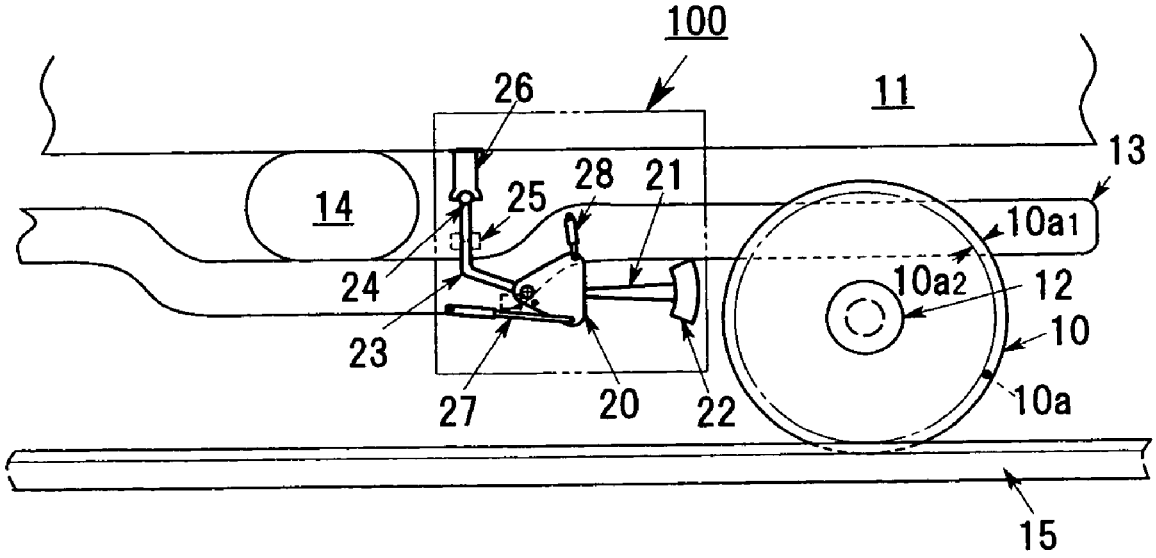
FIG. 1 is a schematic elevational view showing a relation between a derail protection apparatus 100 of the first embodiment and a rolling stock.

Major reference numerals or characters are explained as follows, in which a like or similar element is designated by the same reference numeral or character, in which:

100, 200, 300, 400, 500, 600; derailment protection apparatus,

10; wheel,

11; car body,

13; bogie,

20; rotary member,

21; supporting member,

22, 40; wheel guiding member (first guiding portion or blade 22, second guiding portion or protrusion 40),

23; rod-like member,

23*a*, 24, 26*a*, 26'*a*; flexible joint,

24, 25, 26; abnormal vibration responsive device, shock sensor, shock breaker,

27, 28; spring,

29; lock device,

31; movable shaft,
32; vibration sensor,
33; high pressure gas (fluid) valve,
34; gas (fluid) cylinder,
35; compressed gas (fluid) cylinder,
36; power source,
37; electric wiring,
38; piping,
50; electric wiring,
51; electric wiring,
52; electric wiring,
53; rack,
54; pinion,
55; motor,
57; wheel guiding member ascending device,
60; lock device,
82; roller,
83; roller,
84; groove,
90; spring,
91; tubular member (guiding tube),
92; cylindrical member,
93; lock device,
94; lock device.

DETAILED DESCRIPTION OF THE INVENTION

Some embodiments of a rail derailment protection apparatus of the present invention will now be described in detail with reference to the accompanying drawings.

In the drawings, like or similar elements, parts or portions are denoted by the same reference numeral in the several views.

A First Embodiment of the Invention

Referring to FIG. 1 through FIG. 15, the first embodiment of the invention is described in detail.

FIG. 1 is a schematic elevational view showing a relation between a derail protection apparatus 100 of the first embodiment and a rolling stock.

Figure 2:
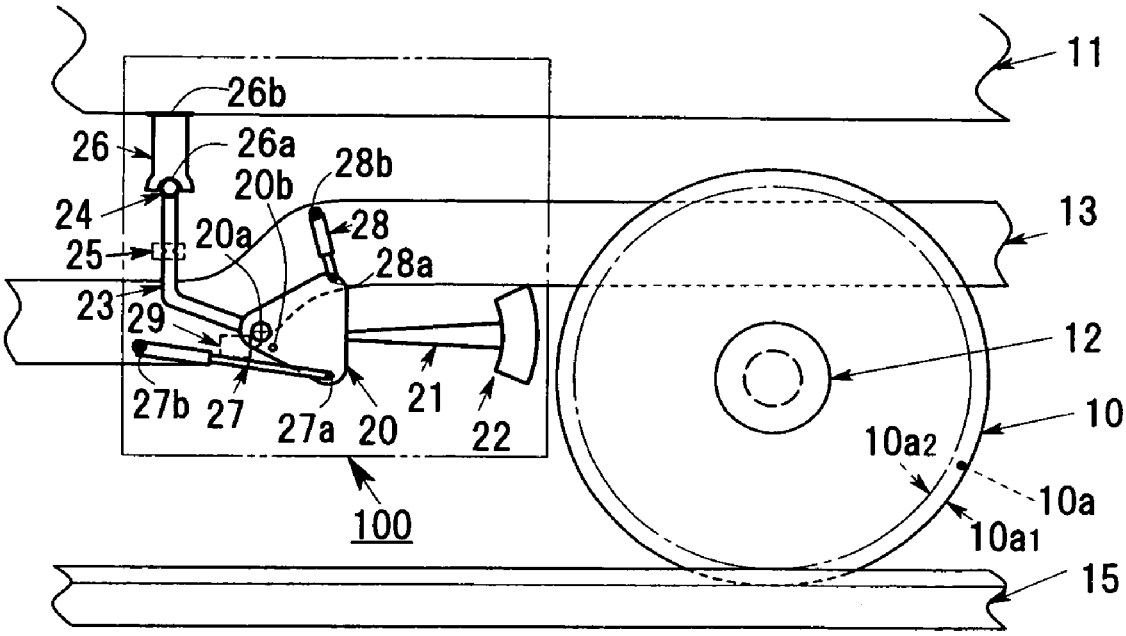
FIG. 2 is a schematic enlarged elevational view showing the derail protection apparatus 100.

FIG. 2 is a schematic enlarged elevational view showing the derail protection apparatus 100.

Figure 3:
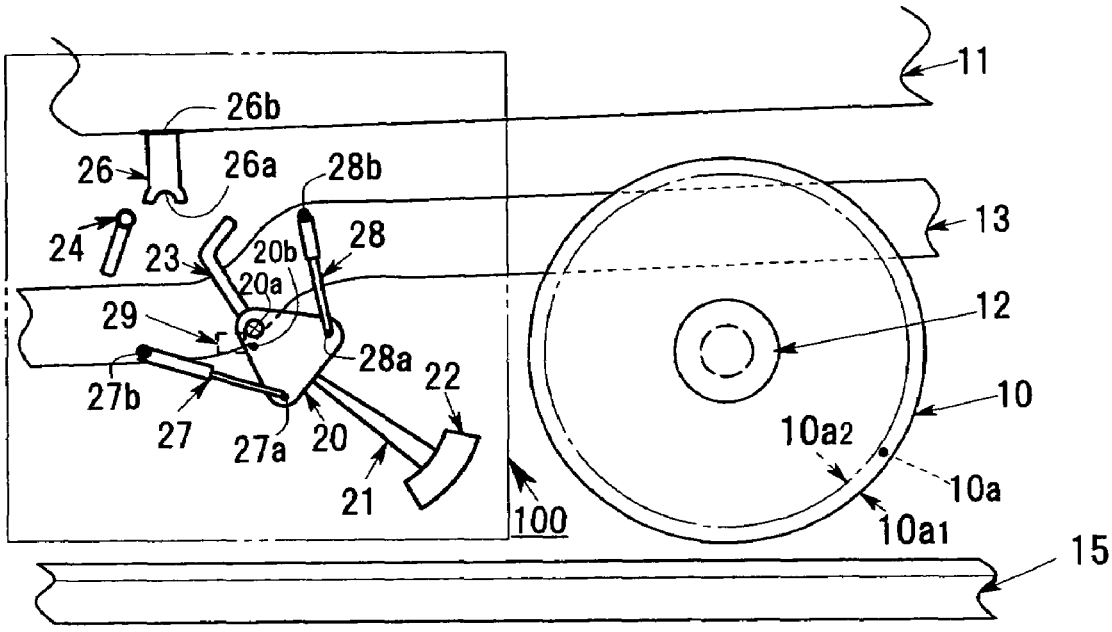
FIG. 3 is a schematic enlarged elevational view showing the derail protection apparatus 100 in a condition to activate operating.

FIG. 3 is a schematic enlarged elevational view showing the derail protection apparatus 100 in condition to activate operating.

Figure 4:
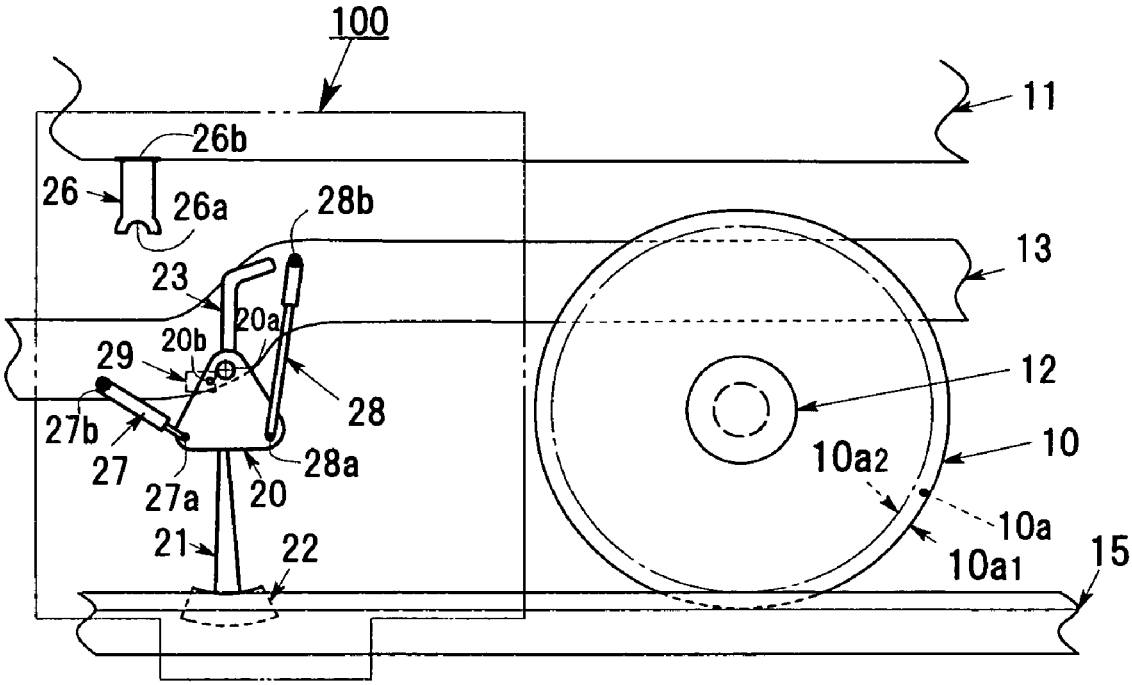
FIG. 4 is a schematic enlarged elevational view showing a relation between the derail protection apparatus 100 and a bogie, when a derailed wheel is guided to return in an original position after actuation of the derail protection apparatus 100.

FIG. 4 is a schematic enlarged elevational view showing a relation between the derail protection apparatus 100 and a bogie, when a derailed wheel is guided to return in a normal or original position on actuation of the derail protection apparatus 100.

Figure 5:
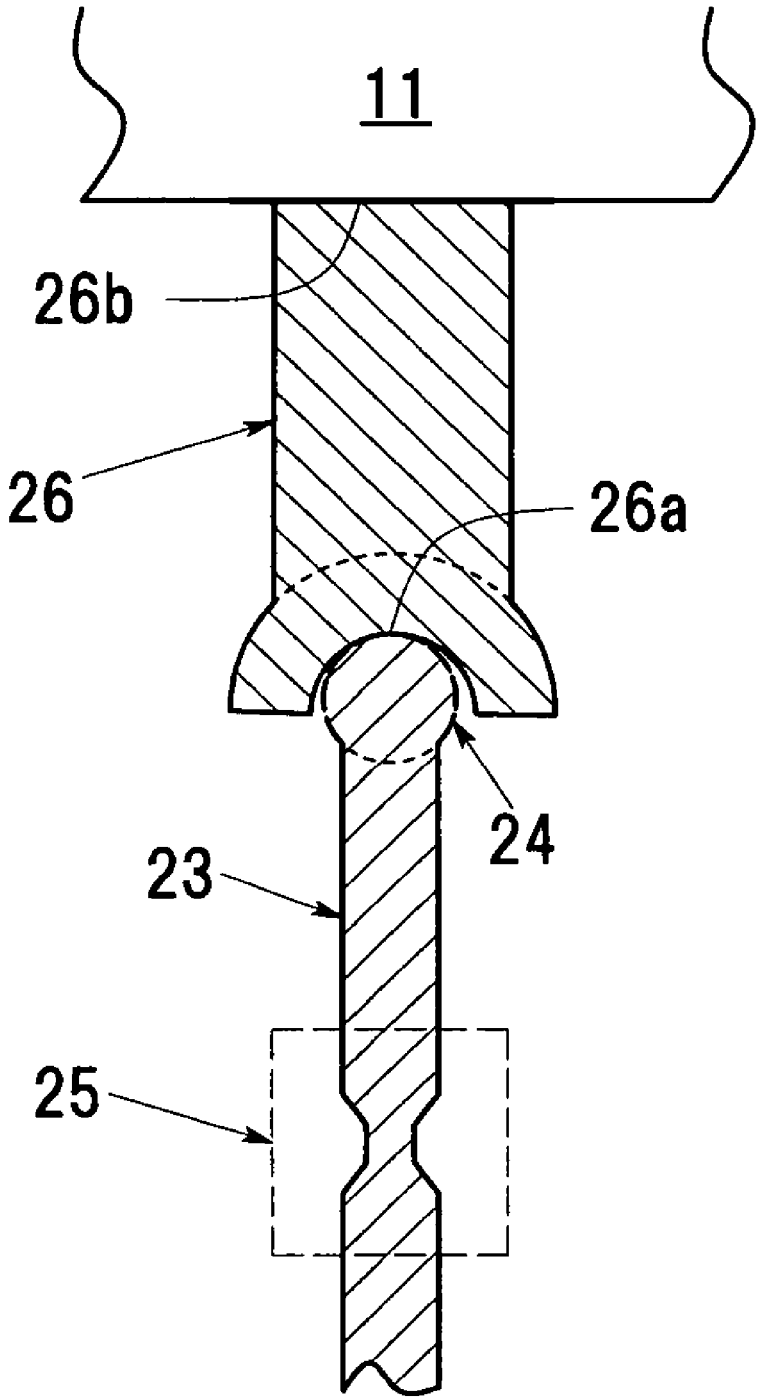
FIG. 5 is a schematic enlarged cross sectional view showing one kind of shock sensors (an abnormal vibration responsive device) 24, 25 and 26.

FIG. 5 is a schematic enlarged cross sectional view showing one kind of shock sensors (an abnormal vibration responsive device) 24, 25 and 26.

Figure 6:
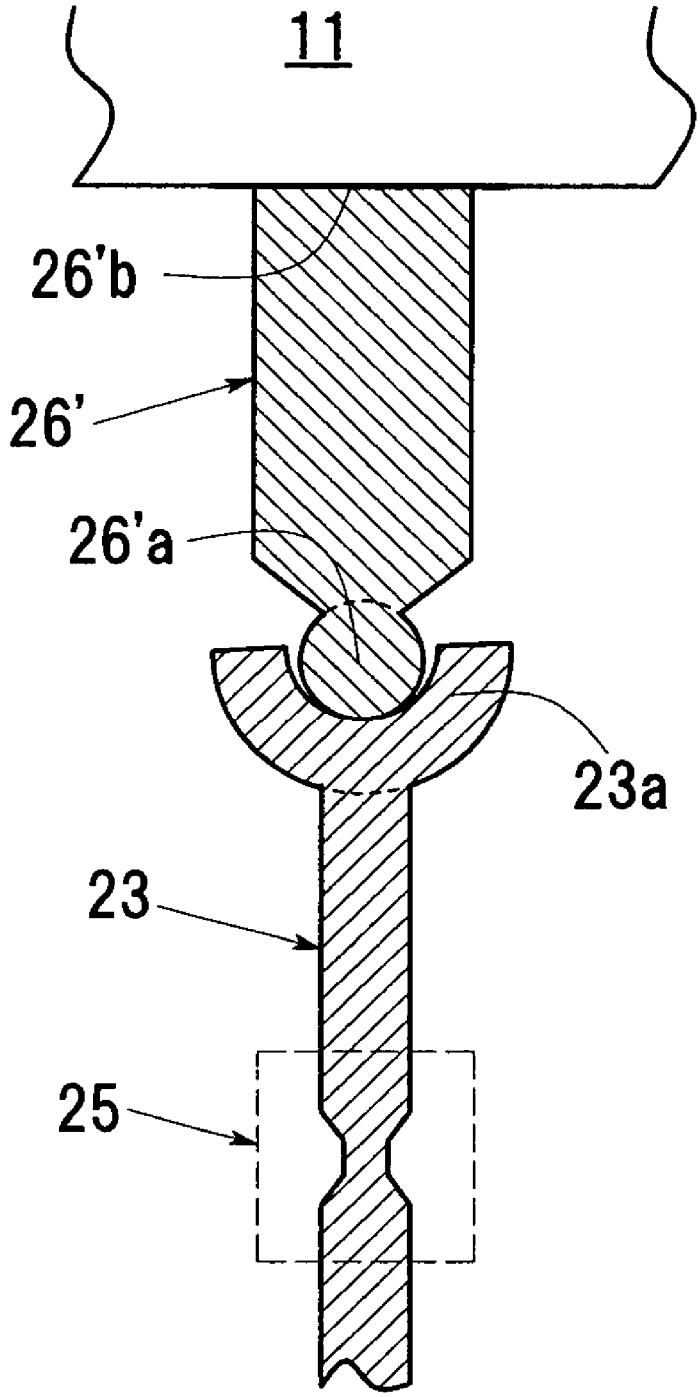
FIG. 6 is a schematic enlarged cross sectional view showing another kind of shock sensors (an abnormal vibration responsive device) 24, 25 and 26'.

FIG. 6 is a schematic enlarged cross sectional view showing another kind of shock sensors (an abnormal vibration responsive device) 24, 25 and 26'.

Figure 7:
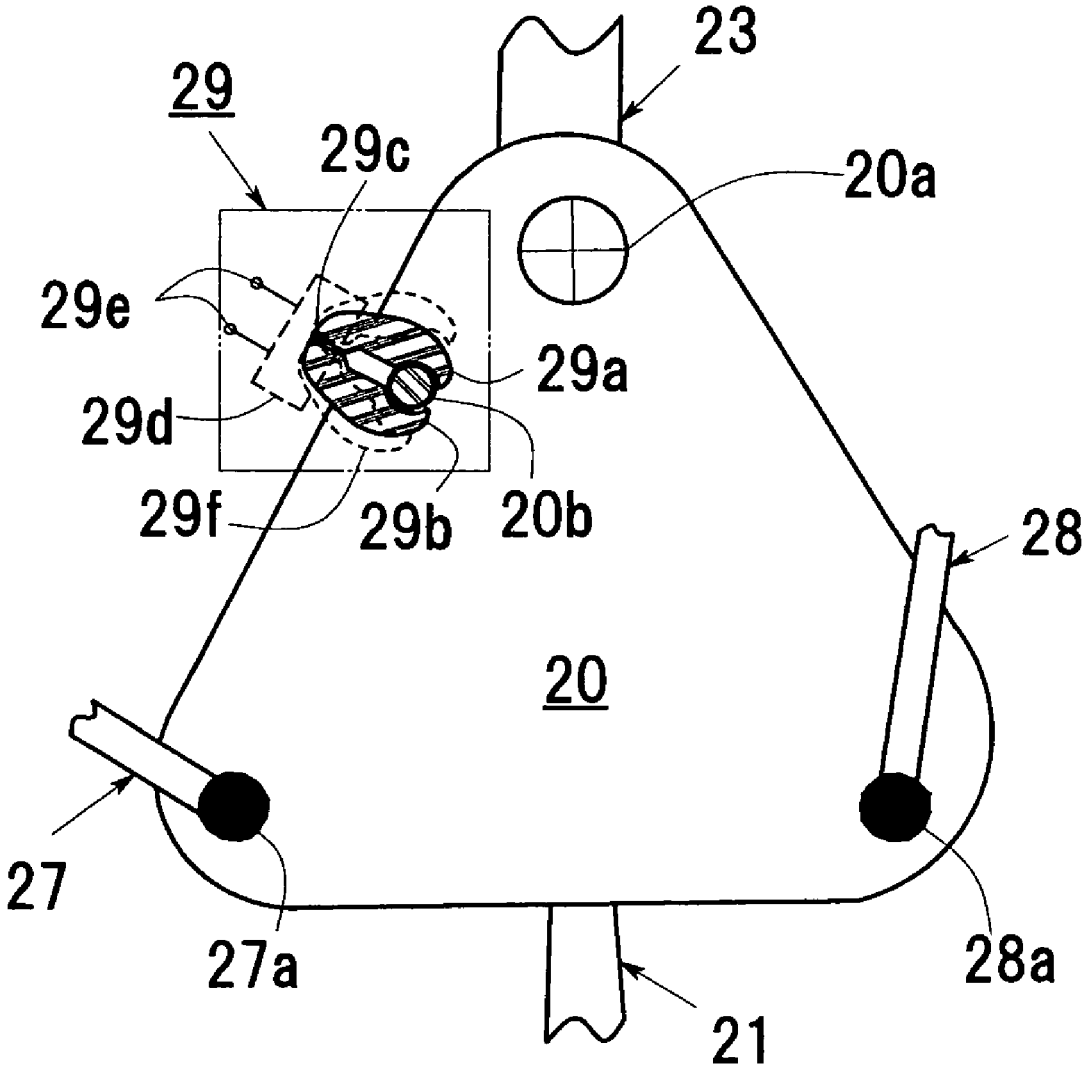
FIG. 7 is a schematic enlarged cross sectional view showing a relation between a rotary member 20 and a rock device 29.

FIG. 7 is a schematic enlarged cross sectional view showing a relation between a rotary member 20 and a rock device 29.

Figure 8:
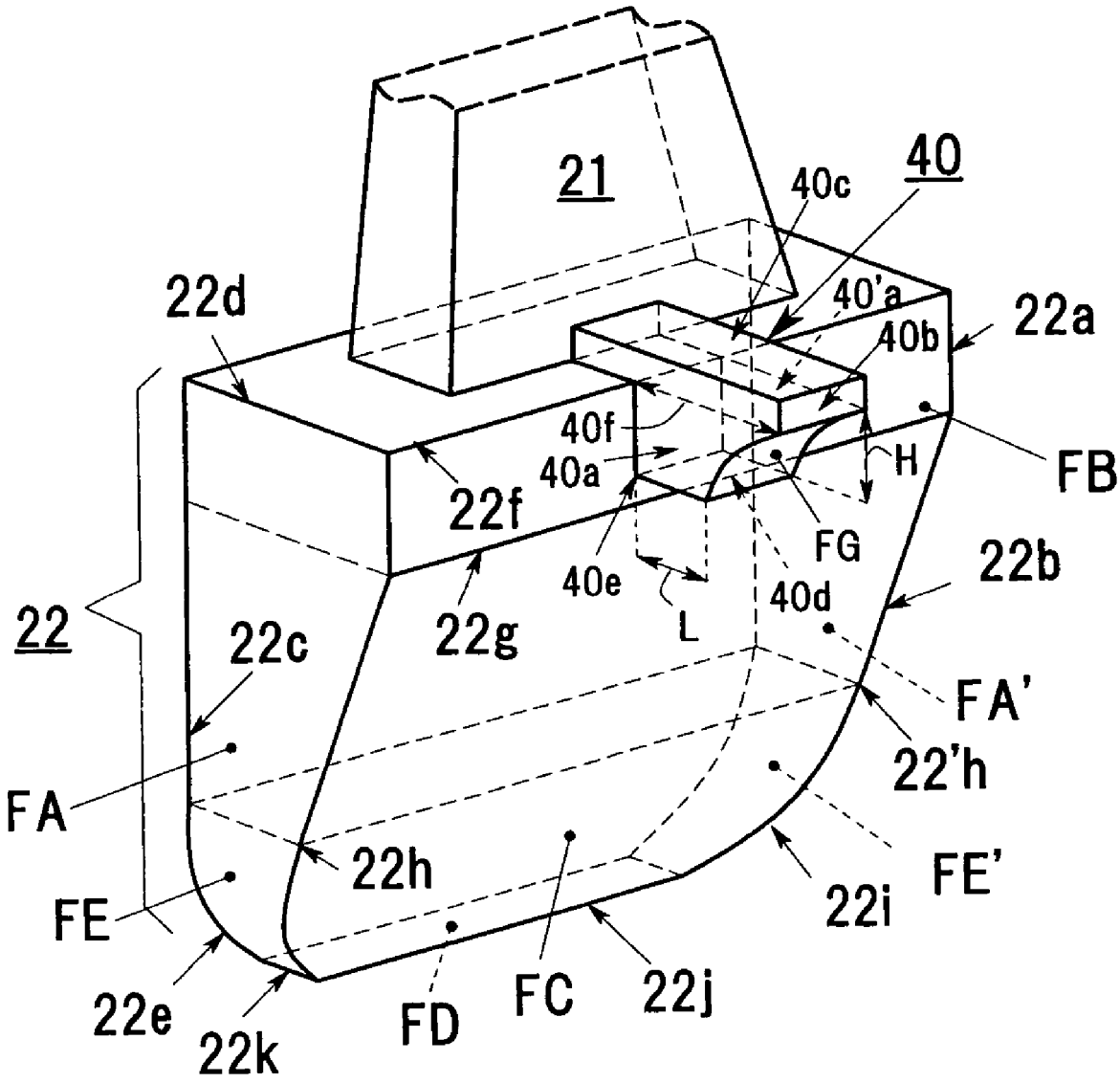
FIG. 8 is a schematic enlarged perspective view showing a wheel guiding member 22.

FIG. 8 is a schematic enlarged perspective view showing a wheel guiding member 22.

Figure 9:
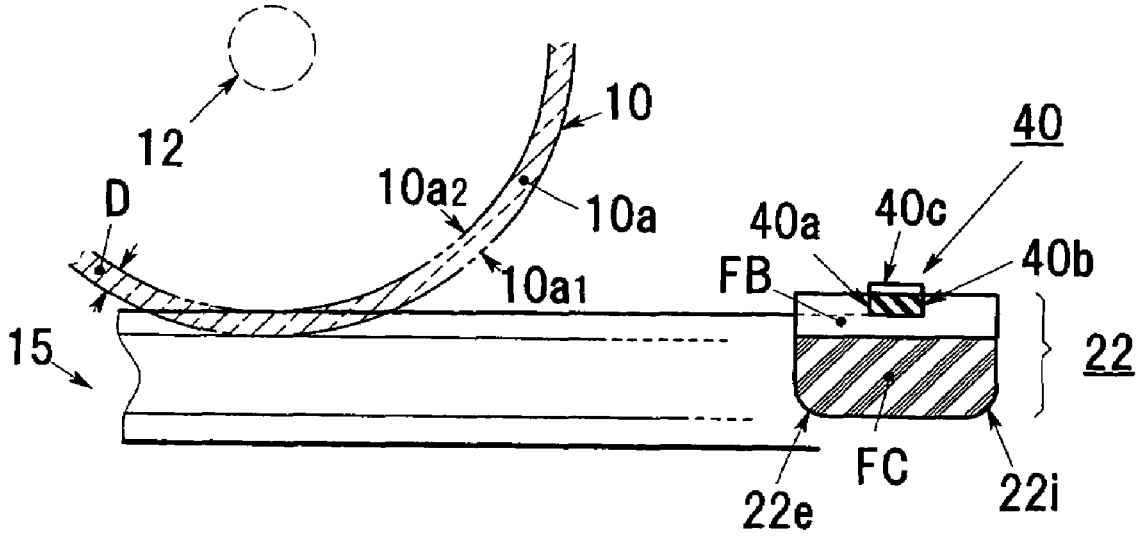
FIG. 9 is a schematic enlarged side view showing a relation between the wheel guiding member 22 and a wheel 10.

FIG. 9 is a schematic enlarged side view showing a relation between the wheel guiding member 22 and a wheel 10.

As shown in FIG. 1 to FIG. 4, a railway rolling stock is generally composed of a car body 13*a*, two bogies 13 and wheels 10 attached therein, in which the car body 13 is mounted on the bogie 13 via a shock-absorber 14 such as an air spring.

The railway rolling stock with bogies runs on a pair of rails 15. A flange of the wheel 10 is denoted by a reference numeral 10*a*.

As shown in FIG. 1 to FIG. 9, the derailment protection apparatus 100 helps the derailed wheel to return to an original position, if the bogie 10 elevates abnormally due to an abnormal vibration or shock caused by such as an earthquake.

The derailment protection apparatus 100 is composed of an abnormal vibration responsive device (24, 25, 26) or (24, 25, 26') and a wheel guiding device having a wheel guiding member 22 and a supporting member 21, in which the supporting member 21 supports or fixes the wheel guiding member 22 at one end of the supporting member 21 and another end of the supporting member 21 is fixed to the bogie 13 in an abnormal state.

In more detail, the wheel guiding means is composed of a substantially triangular rotary member 20, the wheel guiding member 22, the supporting member 21 and a rod-like member 23.

The wheel guiding member 22 is positioned near the bogie 13 in a normal state.

The rod-like member 23 may form an arm-like shape.

The rotary member 20 is positioned on the bogie 13.

The rotary member 20 is further composed of a de-centered rotate-able axis 20*a* that is a rotating center.

The rotate-able axis 20*a* is fixed on the bogie 13.

The supporting member 21 is further composed of one end to connect to a portion of the rotary member 20 and another end to extend to a first flexible joint member 24.

By such configuration, the rotary member 20 rotates when the abnormal vibration responsive device (24, 25 and 26) detects an abnormal vibration or shock, then the wheel guiding member 22 descends to a position to contact a side face or a top face of the rail 15 and the wheel guiding member 22 guides the derailed wheel 10 to return to a top face of the rail 15 in the normal original position.

Referring to FIG. 5, an abnormal responsive device for actuating the derailment protection device 100 is explained in detail.

The abnormal responsive device may be composed of a first shock sensor and a second shock sensor.

The first shock sensor is composed of one flexible joint 24 positioned at a free end of an arm 23 and another flexible joint 26*a* positioned at a free end of a joint member 26 that are installed between a car body 11 and the abnormal responsive device, in which the derailment protection apparatus 100 starts to be actuated by deviation due to large dislocation generated between the bogie 13 and the car body 11 when an abnormal lateral sway occurs.

The second shock sensor is composed of a shock breaker 25 positioned at a partway of the arm 23 so that the arm 23 itself breaks when an abnormal force is suddenly applied to the shock breaker 25.

The first flexible joint 24A may have a convex shape such as a substantially ball-like or spherical shape.

A substantially rod-like member 26 is positioned corresponding to the first flexible joint 24A.

The rod-like member 26 is provided with the second free end 26*a* positioned at one end having a concave shape such as a dish-like, bow-like, reverse dome-like shape and a fixed end 26*b* positioned at another end for fixing to the car body 11.

Therefore, the second free end 26*a* and the first flexible joint 24 are freely movable or slide-able to each other in a normal running state.

As shown in FIG. 6, different from the substantially rod-like member 26 as shown in FIG. 5, a substantially rod-like member 26' is provided with a flexible joint 26"*a* having a convex shape positioned at one end and a fixed end 26"*b* to be fixed to the car body 11, in which the second flexible joint 23*a* has a concave shape positioned at one end of the second arm 23.

Therefore, the first flexible joint 24 and the second free end 26*a* in FIG. 5 (or the flexible joint 26"a and the flexible joint 23*a* in FIG. 6) are freely movable or slide-able to each other in a normal state where the railway car or rolling stock is running normally accompanied with a normal vibration.

When an earthquake generates, various forces with multiple directions occur such as vertical and lateral forces.

The bogies 13, the car body 11 and the rolling stock generate various movements due to such various forces.

As the abnormal vibration responsive device for actuating the derailment protection apparatus 100, the dual shock sensors (the first sensor 25 and the second sensor (26*a* and 24) or (26"*a* and 23*a*)) are preferably adopted to reduce a damage of a running train.

When the car body 11 receives a large vibration or abnormal vibration more than a magnitude of predetermined permissible range with various directions such as vertical and/or lateral directions due to such as earthquake, the flexible joint 23*a* positioned at the arm 23 is largely deviated from the flexible joint 26"*a* of the rod-like member 26' fixed to the car body 11.

Therefore, the rotary member 20 begins to activate.

When a shock power caused by an earthquake wave with horizontal direction more than a predetermined value is added to the derailment protection apparatus 100, the second arm 23 receives a large mechanical force and the shock sensor 25 (the abnormal vibration responsive device) breaks.

When each or both of the dual shock sensors (the first sensor 25 and the second sensor (26*a* and 24) or (26"*a* and 23*a*) are operated, the rotary member 20 begins to activate.

To get a quick response of the shock sensor 25 (the abnormal vibration response device) may be provided with a slit or slits (not shown in the drawings) formed along a running direction of the rail car or rolling stock that are more easy to break to the running direction.

It is desirable to provide with forced rotating devices 27 and/or 28 for ensuring the rotary member 20 to turn, when the shock sensors (24, 26*a*) and/or 25 (the abnormal vibration response device) begins to rotate.

In the first embodiment, the forced turn devices 27 and/or 28 are provided with a first spring member 27 such as a first coil spring to act in a pulling direction and a second spring member 28 such as a second coil spring to act in a pushing direction.

The first spring member 27 has one end 27*a* and another end 27*b*, in which the end 27*a* is connected to the rotary member 20 and the end 27*b* is connected to the bogie 13.

The second spring member 28 has one end 28*a* and another end 28*b*, in which the end 28*a* is connected to the rotary member 20 and the end 28*b* is connected to the bogie 13.

As shown in FIG. 1 to FIG. 4, a railway rolling stock (i.e. railroad rolling stock) is generally composed of a car body 13*a*, two bogies 13 and wheels 10 attached therein, in which the car body 13 is mounted on the bogie 13 via a shock-absorber 14 such as an air spring.

The lock device 29 strongly acts to return the heavy bogie 13 to a normal position when the derailment protection device 100 is operating.

The lock device 29 may be composed of a pair of finger-like members 29 (29*a* and 29*b*) that are fixed on the bogie 13 and a pin-like member 20*b* fixed on the rotary member 20, in which the pin-like member 20*b* can be held by the finger-like members 29*a*.

The finger-like members 29 (29*a* and 29*b*) operates to fix strongly between the rotary member and the bogie in an emergency state.

The finger-like members 29 (29*a* and 29*b*) may be provided with a releasing device having a driving device 29*d* such as an electromagnetic coil and a pair of electro-conductive lead wires 20*e* to supply an electric energy from an electric power supply (not shown in the drawings).

In a normal state, the lead wires 29*e* supply electricity to the lock device 29 so that the finger-shaped members 29*a* and 29*b* are opened with a center of rotation 29*c* as the fulcrum.

In FIG. 7, a reference numeral 29*f* shows an open state of the finger-shaped member 29*a* and 29*b*.

In an abnormal state, the finger-shaped member 29*a* and 29*b* are closed with a center of rotation 29*c* as the fulcrum.

The rotary member 20 rotates along a rotating axis 20*a* to be a rotating center.

The pin-like member 20*b* fixed on the rotary member 20 reaches within the finger-shaped member 29*a* and 29*b* to be held by the finger-shaped member 29*a* and 29*b*, at that time a switch (not shown in the drawings) becomes OFF to lock the lock device 29, thereby the rotary member 20 is exactly fixed to the bogie 13.

A mechanical lock device using a spring may substitute the electromagnetic lock device 29 mentioned above.

FIG. 8 is a schematic perspective view of the blade member 22 according to an embodiment of the present invention.

FIG. 9 is an enlarged schematic side view of the blade member 22 showing a positioning relation between the blade member 22, a wheel 10 and a rail or rails 15.

The blade member 22 may be composed of a first guide portion 22 having an inclined face FC and a second guide portion 40 having a laterally extended member.

The blade member (the first guide portion) 22 and the second guide portion 23 may be made from an inorganic material that withstands a strong shock applied to the derailment protection apparatus 100 in that operating state, such as a metallic material (a steel, cast iron or stainless steel) or a ceramic material In stead of the inorganic material, the blade member (the first guide portion) 22 and the second guide portion 23 may be made from an inorganic and organic composite that may be composed of a heat resistant polymer and metal powder, ceramic powder included in the polymer or resin.

As the heat resistant polymer, a thermoplastic resin or a thermosetting resin may be used.

The inorganic material, the blade member (the first guide portion) 22 and the second guide portion 23 may be molded by applying heat and pressure at the same time to produce a unitary structure.

In stead, the blade member (the first guide portion) 22 and the second guide portion 23 may be made from a fiber reinforced resin composed of fiber/fibers such as glass fiber, carbon fiber or metallic fibers and a resin material as a binder of the fiber/fibers.

In stead, an organic and inorganic composite member including a heat resistant polymer may be fixed on major surface/surfaces such as the face FC and the curved face 22*e*, in which the organic and inorganic composite member may be formed by a molding process.

As shown in FIG. 8, the blade member (the first guide portion) 22 may be a substantially hatchet-like or taper-like structure as a whole.

The blade member (the first guide portion) 22 may be composed of a surface to face a side face of a rail.

The surface may be further composed of a substantially rectangular first surface FB and a substantially rectangular second surface FC, in which the first surface FB is positioned between substantially horizontal side surfaces 22*f* and 22*g* opposed each other and the second surface FC is inclined downwardly from the first surface FB.

Furthermore, the blade member (the first guide portion) 22 may be composed of a pair of opposed flat side surfaces FA and FA' having substantially the same shape and a pair of curved opposed side surfaces FE and FE' having substantially the same shape, in which the curved opposed side faces FE and FE' are positioned downwardly from the flat side surfaces FA and FA".

Further, the side surfaces FA and FA' are composed of substantially rectangular opposed surfaces each having a substantially horizontal side 22*d* and substantially opposed taper-like surfaces positioned downwardly from the rectangular opposed surface.

As shown in FIG. 8, a border side to connect with the side surfaces FA and FE and the major surface FB and FC is composed of a substantially vertical portion 22*a* or 22*a*' and an inclined portion 22*b* or 22*b*', in which a gap or distance between the border side and the substantially vertical side 22*c* opposed to each other is substantially equal in the vertical portion 22*a* or 22*a*' and the gap or distance becomes gradually smaller downwardly in the inclined portion 22*b* or 22*b'*.

Further, the side surface FE or FE' has a curved side 22*e* or 22*e*' from a border portion 22*h* or 22*h*' of the side surface FA or FA' to a bottom side 22K or 22*k'*.

As shown in FIG. 8 and FIG. 9, the blade 22 is set so that the bottom surface FD stops at a position that is higher height than protrusions such as clamps installed on wooden sleepers.

An upper portion of the blade 22 may be composed of a rectangular solid structure including three sides 22*a*, 22*d* and 22*g* and a rod-like substrate 21 is rigidly fixed to the blade 22 at a top surface of the rectangular solid structure by fixing means such as welding or thread, in which the blade 22 is supported by the rod-like substrate 21 to act as a shaft.

The side line 22*g* of the blade 22 downs to the similar height of a circumference 10*a*1 of a flange 10*a* in a wheel 10, when the derailment protection apparatus 100 is operating.

When the derailment protection apparatus 100 is operating, the blade 22 stops descending in a position corresponding to an inclined inner surface of the circumference 10*a*1 of a flange 10*a* in a wheel 10.

The surface FC of the blade 22 has an inclined surface to extend to an inner direction downwardly from the side line 22*g* to a bottom side line 22*j*.

A inclined angle of the inclined surface FC is set at a position far from the position of the inner line 22*c* of the blade 22 when the derailment protection apparatus 100 is operating, so that the blade 22 does not conflict with various wayside devices such as automatic train stop (ATS) or automatic train control (ATC) wayside devices installed between dual rails.

The wheel 10 is protected from a derailment in an outside of the rail, when the blade 22 is designed so that the upper side 22*d* is thick and the bottom side 22*k* is thin, as much as possible.

As shown in FIG. 8, the blade 22 is provided preferably in a symmetrical shape with the curved surfaces 22*e* and 22*i* downwardly from positions of points 22*h* and 22*h*' before and behind a train moving direction, so that a train can run through obstructions such as point and crossings existed between the dual rails till the train stops when the derailment protection apparatus 100 is operating and a body of the blade 22 is easy to set in a predetermined position to the wheel 10.

As shown in FIG. 8, the second guiding portion 40 may be fixed on the rectangular solid structure positioned in an upper portion of the first guiding portion (blade) 22 and the second guiding portion 40 protrudes in a vertical direction to outside of the rail from the rectangular surface FB of the rectangular solid structure.

A shown in FIG. 8, the second guiding portion 40 is composed of a protruded structure that protrudes from the first guiding portion (blade) 22 to an outside thereof.

The protruded structure 40 may have a substantially flat top surface 40*c*, a substantially flat bottom surface 40*d* opposed to the top surface 40*c*, substantially flat side surfaces 40*a* and 40*a*' opposed to each other, a substantially flat lateral surface 40*b* and a curved surface "FG" for guiding the wheel 10.

A curvature of the curved surface "FG" is extended upwardly from an outside of a bottom side with a length "L" corresponding to a width of the wheel 10 to the lateral surface 40*b*.

A distance from an outside point in a top of the curved surface "FG" to the surface "FB" of the blade 22 is denoted as a reference numeral "40*f*".

A horizontal height from the bottom surface 40*d* to a top side of the curved surface "FG" or to a bottom side of the lateral surface 40*b* is denoted as a reference character "H".

The bottom surface 40*d* is fixed to connect with the surface FB of the blade 22 at a position upper than the bottom side 22*g*, in which the bottom side 22*g* is positioned larger than a height of the flange 22*g* of the wheel 10.

The curved surface FG of the second rail guiding member 40 can guide the wheel 10 in the abnormal state to return a normal position on the rail so that the curved surface FG prevents the wheel 10 from descending toward an inner side of the rail.

The height "H" of the curved surface FG is preferably shorter than a total height of the rail 15. The length 40*f* is long enough for protecting the derailment of the wheel 10.

The lateral side surface 40*b* having an inclined face is much effective like the inclined surface FG.

The second guiding portion 40, the first guiding portion (blade) 21 and/or the supporting member may have a unitary structure to increase strength.

The second guiding portion 40, the first guiding portion (blade) 21 and the supporting member may be unified to form a single structure to increase strength.

When the derailment protection apparatus 100 is operated, the first guiding portion (blade) 22, the second guiding portion 40, wheel 10 and the rail 15 are positioned as shown in FIG. 9.

In FIG. 9, a distance between an outer circumference 10*a*1 and an internal circumference 10*a*2 is denoted as a reference mark "D" and an axle of the wheel 10 is denoted as a reference numeral "12".

As shown again in FIG. 3, the wheel 10 rises together with the axle 12 so as to go away and deviate from the rail 15 in right and left, when the derailment protection apparatus 100 activates to operate in such a case that the wheel 10 receives an abnormal shock and a strong vibration through the rail 15.

At that time, the shock sensor 25 shown in FIG. 5 (or FIG. 6) is broken by an abnormal vibration and the first flexible joint 24 deviates from the second flexible joint 26*a* of the joint member 26 so that the rotary member 20 starts to rotate.

At the same time, the rotary member 20 is enhanced to rotate by the first spring member 27 and the second spring member 28.

As shown in FIG. 4 and FIG. 7, the wheel 10 dropping is guided on the rail 15, because the rotary member 20 is locked by the locking mechanism having the pin member 20*b* and the hand device 29 (dual hands 29*a* and 29*b*) so that the rotary member 20 is securely fixed to the bogier 13.

Figure 10:
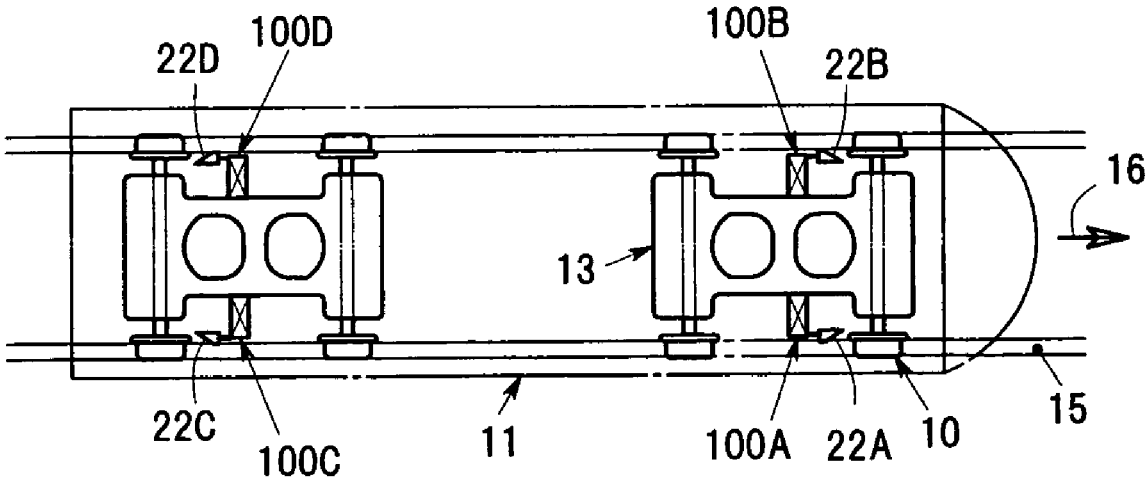
FIG. 10 is a schematic plan view showing the rolling stock 11 in which a plurality of the derailment protection apparatuses 100 may be installed on the rolling stock 11.

FIG. 10 is a schematic plan view showing the rolling stock 11 in which a plurality of the derailment protection apparatuses 100 may be installed on the rolling stock 11.

As shown in FIG. 10, for example, four derailment protection apparatuses 100 (100A, 100B, 100C and 100D) may be installed on each rolling stock 11 in such a manner that every two derailment protection apparatuses (100A and 100B), (100C and 100D) are fixed on two bogies 13 positioned in front and back of the rolling stock 11 and the bogie 13 between the wheels 10.

The derailment protection apparatuses 100A, 100B, 100C and 100D, each is provided with the blade 22A, 22B, 22C or 22D.

In FIG. 10, the rail 15 is denoted as a reference numeral 15 and a moving direction of the rolling stock 11 is denoted as a reference numeral 16.

Figure 11:
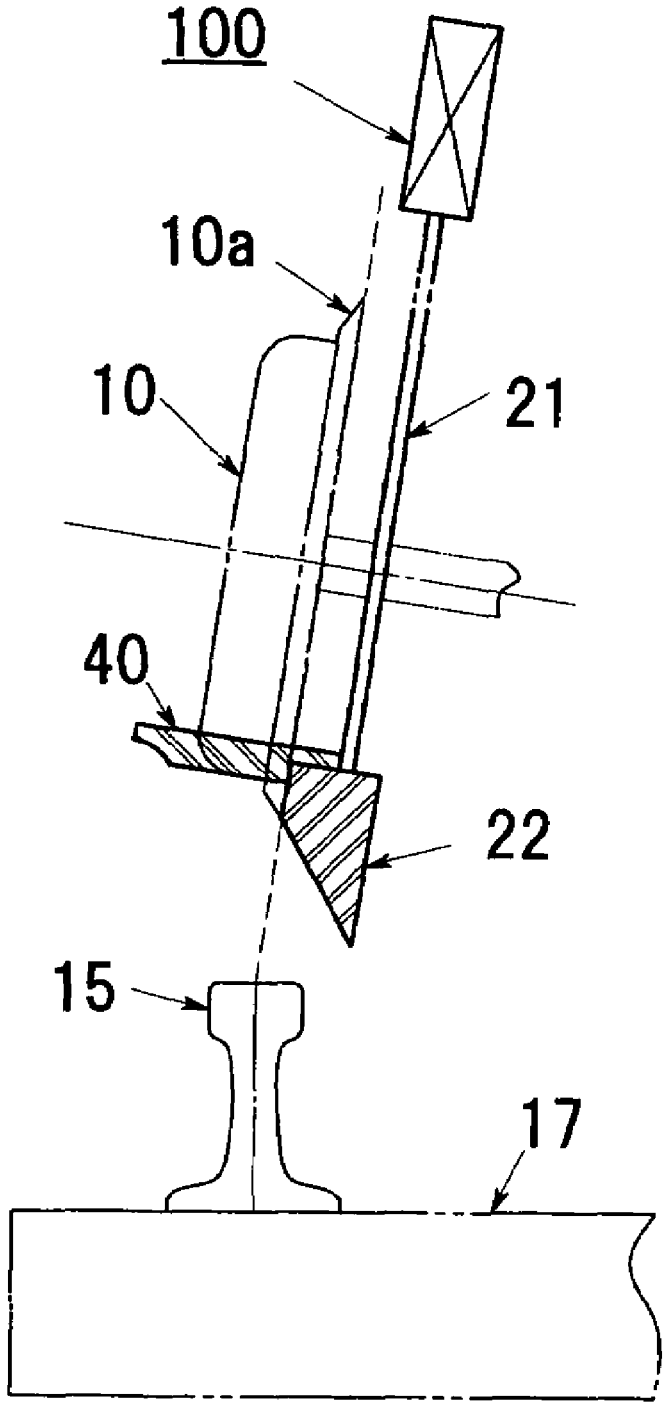
FIG. 11 is a schematic side elevational view showing one state of the derailment protection apparatus 100.
Figure 12:
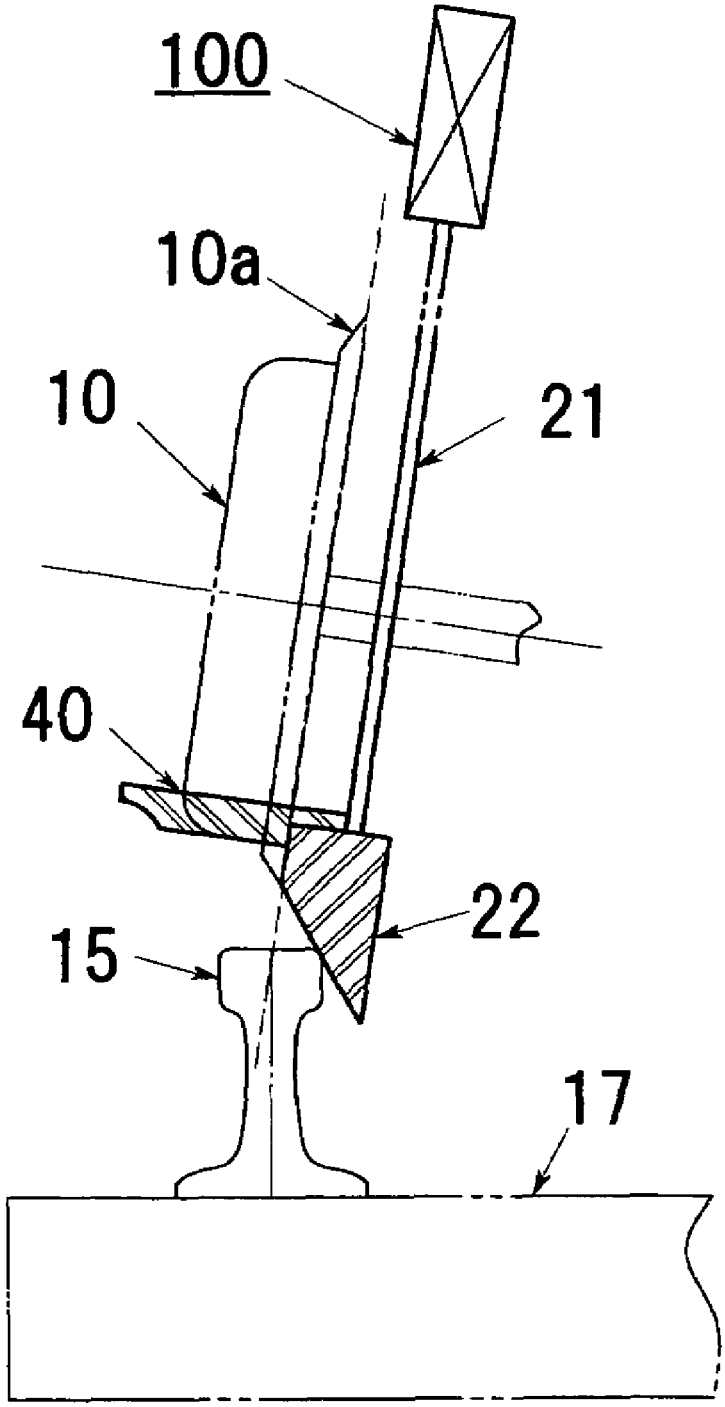
FIG. 12 is a schematic side elevational view showing another state of the derailment protection apparatus 100.
Figure 13:
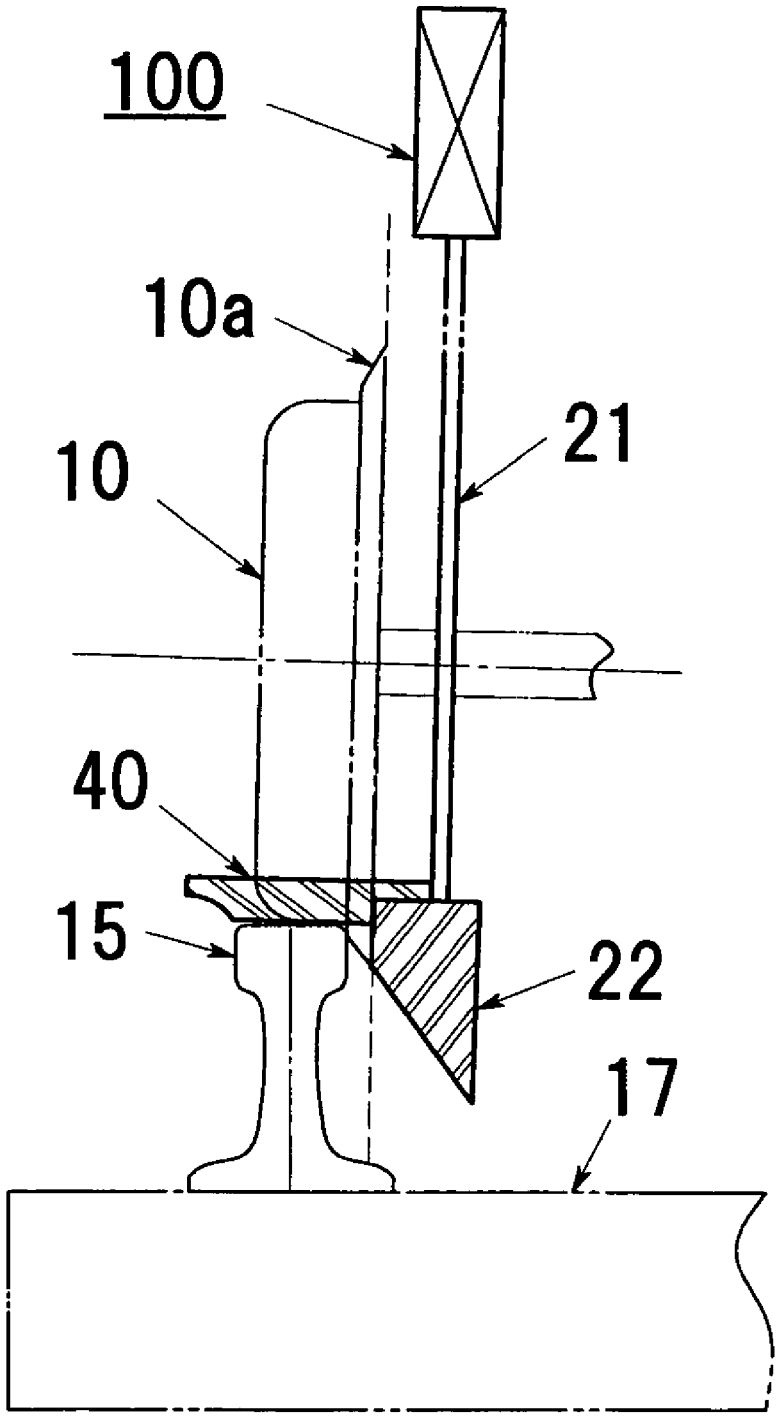
FIG. 13 is a schematic side elevational view showing a still another state of the derailment protection apparatus 100.

Referring to FIG. 11 through FIG. 15, each figure explains now the derailment protection apparatus 100 functions. FIG. 11 to FIG. 13 are schematic side elevational views showing some stepwise states of the derailment protection apparatus 100 showing to recover the wheel 10 from a derailment state.

FIG. 11 shows a first step that the running wheel 10 receives the abnormal vibration, so that the derailment protection apparatus 100 starts to function.

In the first step, when the wheel 10 goes away from the rail 15 and deviates in the outside of the rail 15 due to an abnormal power, the derailment protection apparatus 100 operates or activates so that the blade (the first guide portion) 22 and the second guide portion 40 are set to the wheel 10 so as to return the wheel 10 to a normal position on the rail 15.

Various directional forces are applied to the wheel 10 due to the abnormal vibration.

Therefore, a kinetic energy with the running wheel 10 acts in a floating direction so that the running wheel 10 is forced to float from a top surface of the rail 15, then a derailment may be occurred.

A lateral displacement of the wheel 10 from the running direction is caused by a lateral component of the kinetic energy. The kinetic energy is amplified by rotation of the flange 10*a* of the wheel 10.

In FIG. 11, the support member such as a supporting rod to support the blade 22, a flange of the rail 10 and a sleeper are denoted respectively in that order as reference numerals 21, 10*a* and 17.

In a second step as shown in FIG. 12 (and FIG. 5), after the first step mentioned above, the wheel 10 activates to drop from the outside of the rail 15 so that the wheel 10 activates to be guided by the blade 22 of the derailment protection apparatus 100.

Then, the wheel 10 floated from the rail 15 starts to fall by the gravity of the universal gravitation.

An inclined angle of the inclined surface FC is set at a position far from the position of the inner line 22*c* of the blade 22 when the derailment protection apparatus 100 is operating, so that the blade 22 does not conflict with various wayside devices such as automatic train stop (ATS) or automatic train control (ATC) wayside devices installed between dual rails.

The blade 22 of the apparatus 100 prevents from the derailment to guide the displaced wheel 10 on the normal running surface of the rail 10 to come in contact with an inner side of the rail 10 (or the border surface between the top surface and the inner side of the rail 10), before the surface FC of the blade 22 come in contact with the most outside of the flange 10*a*.

That derailment protection is accomplished by a combined force of a total weight of the wheel 10 and the bogie 13, the kinetic energy in the running and the contact between the running wheel 10 and the rail 15/blade 22.

In a third step as shown in FIG. 13 (and FIG. 5), after the second step mentioned above, the wheel 10 is guided by the inclined surface FC of the blade 22 so that the wheel 10 returns correctly to the normal position on the rail 15.

Figure 14:
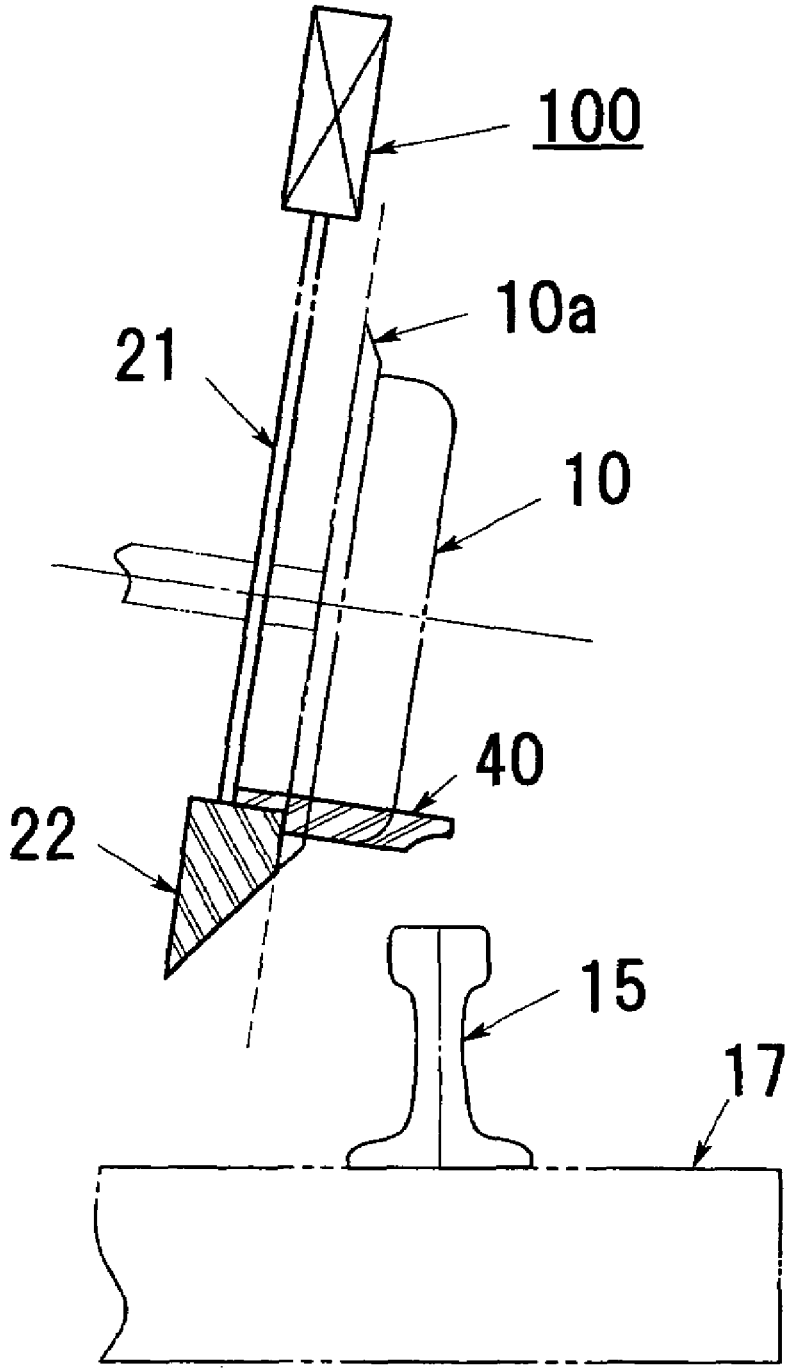
FIG. 14 is a schematic side elevational view showing other state of the derailment protection apparatus 100.
Figure 15:
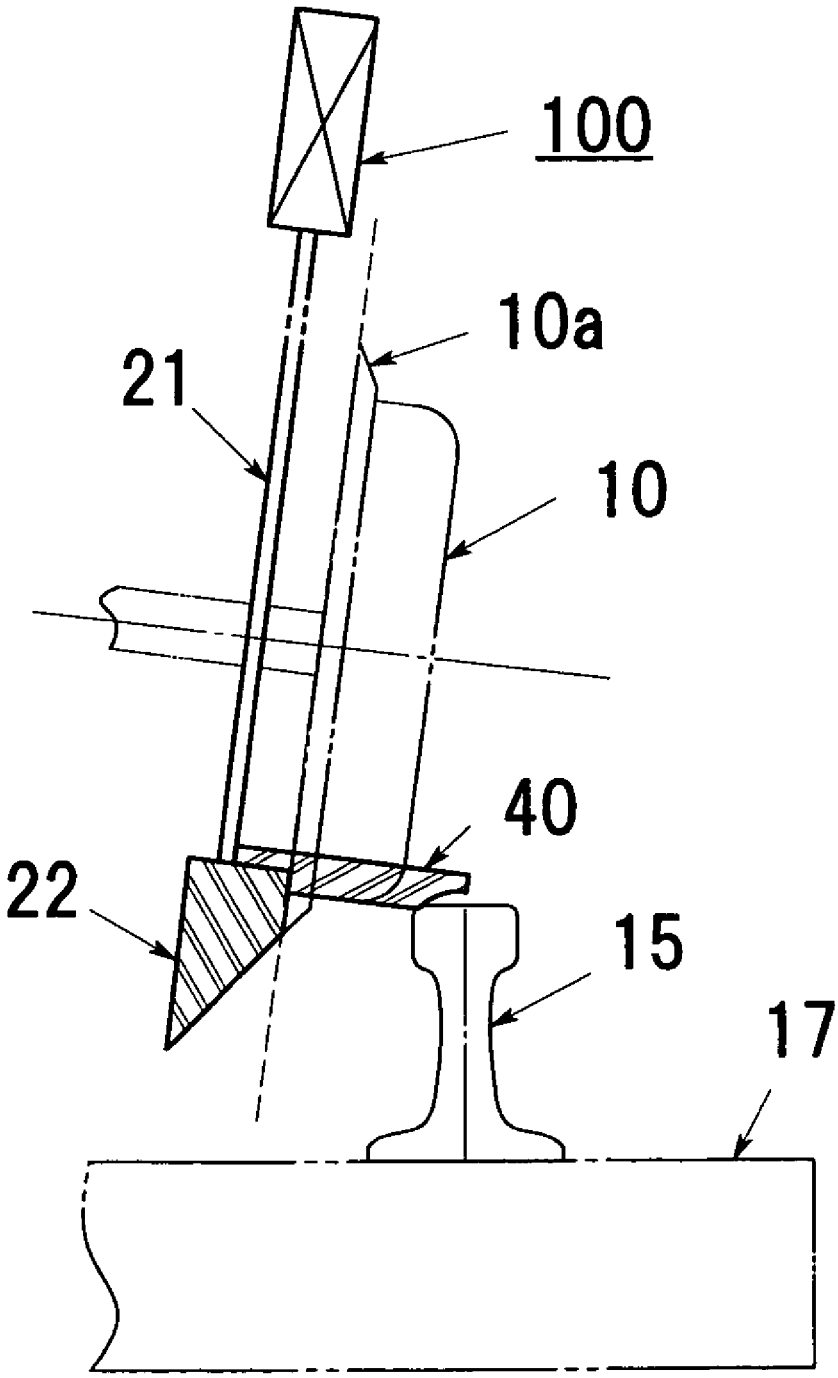
FIG. 15 is a schematic side elevational view showing other state of the derailment protection apparatus 100.

FIG. 14 and FIG. 15 are side elevational view in such a state where the wheel 10 rises and deviates from the rail 15 positioned in an opposite side.

When the wheel 10 deviates to the outer position of the rail 15 due to the abnormal vibration as shown in FIG. 11, another wheel 10 of the same axle deviates to an inner position of another rail 15, that also causes the derailment because the another rail 15 deviates to the inner position.

At that situation, the curved surface FG of the second wheel guiding member 40 starts to contact with the rail 15 before the wheels 10 drop to an inner position of the rails 15. Then, the curved surface FG works to return the inner positioned wheels 10.

Therefore, the wheels 10 can be guided correctly on the running surface of the rail 15 by means of the gravity of the wheel 10 and the bogie 13 and the running kinetic energy.

As shown in FIG. 14 and FIG. 15, the wheel 10 in the reverse side deviates from the rail 15 to an inner direction that differs from the state as shown in FIG. 11 where the wheel 10 deviates from the rail 15 to an outer direction.

At this state, it is conceivable that the wheel 10 drops under a level of the rail 15.

In that case, the second guide portion 40 fixed to the first guide portion (blade) 22 functions to guide the wheel 21 and the second guide portion 40 lifts the wheel 21 to return on the rail 15

As shown in FIG. 15, the wheel 10 activates to be guided to return from an inner side to on the rail 15 by the second guide portion 40.

Under a high speed train operation, the four wheels 10 on the bogie 13 may be running or skipping on the rails 15 not always tracking on the rails 15 due to vibration.

The second guiding portion 40, the first guiding portion (blade) 22 and/or the supporting member 21 may have a unitary structure to increase strength.

Therefore, even if the derailment protection apparatus 100 is not immediately set correctly to the wheels 21 in the states as shown in FIG. 11 to FIG. 15, the derailment protection apparatus 100 can be gradually set correctly to the wheels 21 due to the vibration with up and down directions so that the wheels 21 can be guided to return to the correct position on the rails 15.

A Second Embodiment of the Invention

A derailment protection apparatus according to a second embodiment of the invention is explained referring to FIG. 16, FIG. 17, FIG. 18A and FIG. 18B.

Figure 16:
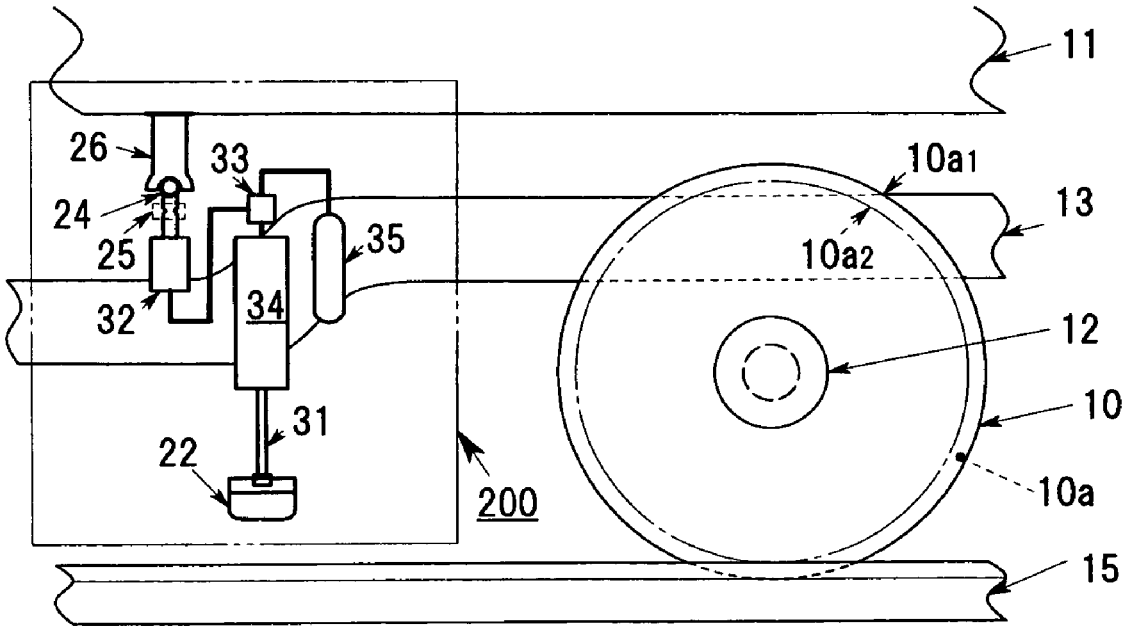
FIG. 16 is a schematic elevational view of the derailment protection apparatus 200 according to a second embodiment of the invention.

FIG. 16 is a schematic elevational view of the derailment protection apparatus 200 according to the second embodiment of the invention.

Figure 17:
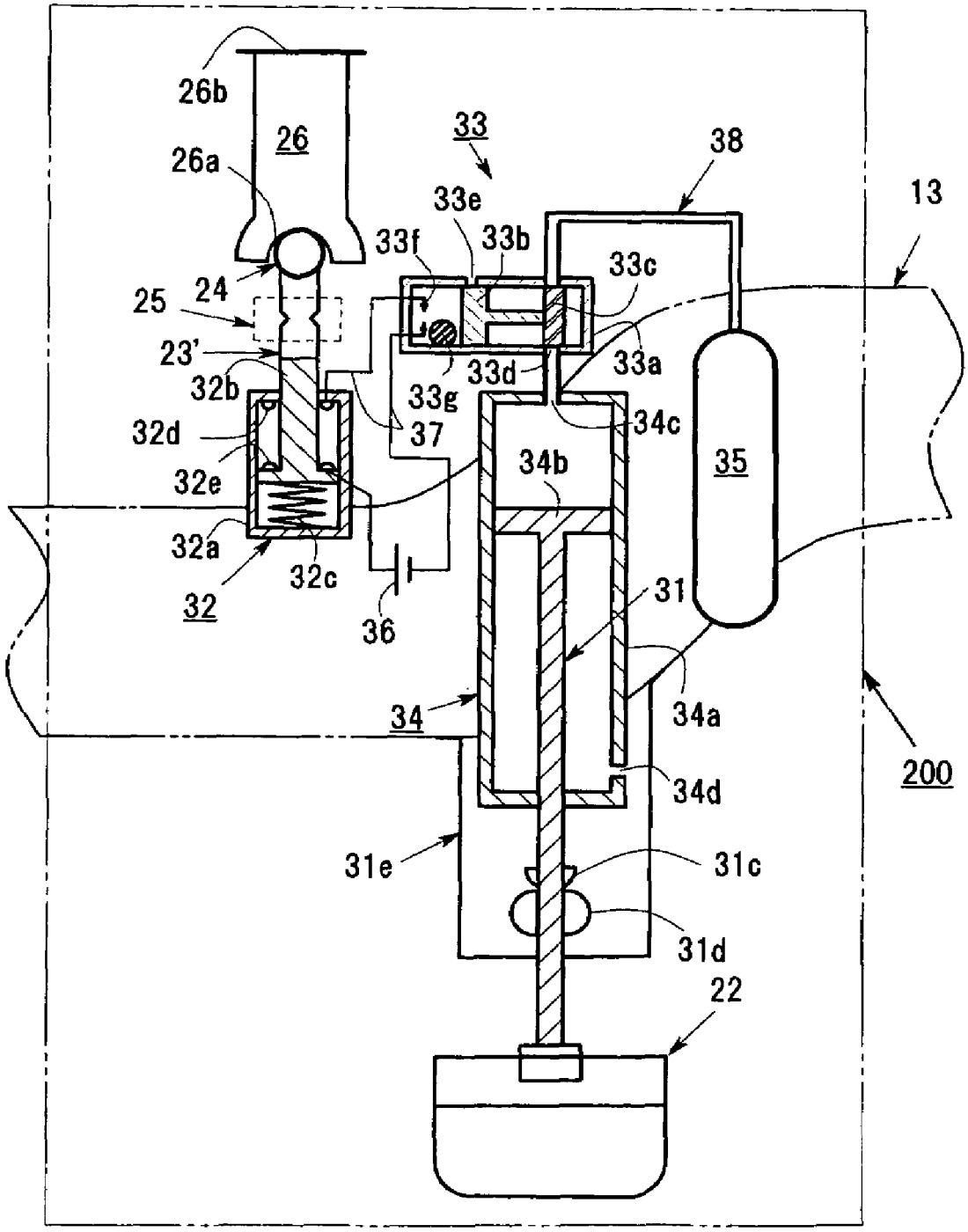
FIG. 17 is a schematic enlarged elevational view in which major portions in FIG. 16 are partially drawn as a cross sectional view.

FIG. 17 is a schematic enlarged elevational view in which major portions in FIG. 16 are partially drawn as a cross sectional view.

Figure 18A:
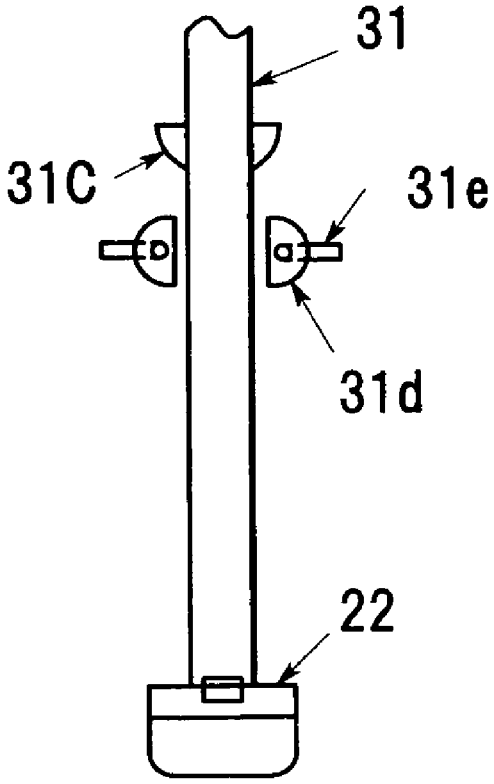
FIG. 18A is a schematic enlarged elevational views to show a lock device and a neighborhood of the lock device shown in FIG. 17 in a normal unlocked state of the lock device and FIG. 18B is a schematic enlarged elevational views to show a locked state of the lock device in which the derailment protection apparatus 200 activates to activate the lock device and the lock device operates.
Figure 18B:
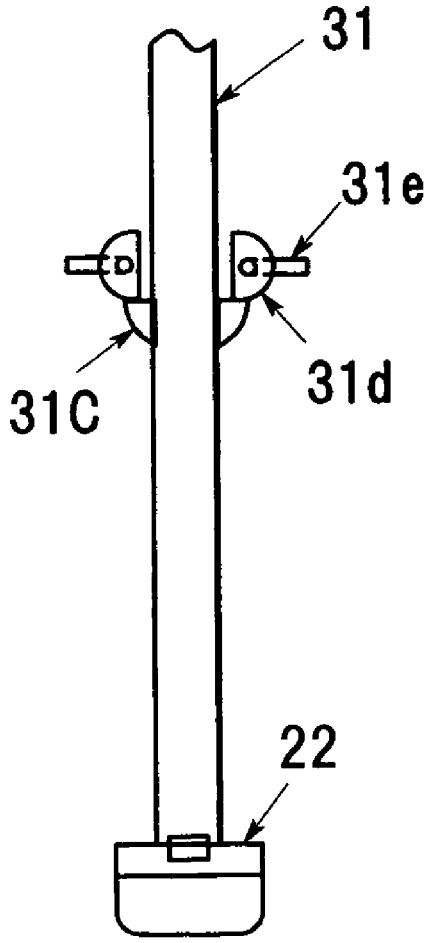

FIG. 18A and FIG. 18B are schematic enlarged elevational views to show a lock device and a neighborhood of the lock device shown in FIG. 17.

As shown in FIG. 4 and FIG. 7, the wheel 10 dropping is guided on the rail 15, because the rotary member 20 is locked by the locking mechanism having the pin member 20*b* and the hand device 29 (dual hands 29*a* and 29*b*) so that the rotary member 20 is securely fixed to the bogie 13.

In the following explanation of the derailment protection apparatus 200 according to a second embodiment of the invention, the explanation duplicated with the first embodiment may be omitted as much as possible.

As shown in FIG. 16 and FIG. 17, the derailment protection apparatus 200 may be composed of an abnormal vibration response means 25 and 32 and a wheel guiding means. The abnormal vibration response means may be composed of a vibration breaker 25 and a vibration sensor 32.

The wheel guiding means may be composed of a blade 22 and a rod-like support 31 to support the blade 22 at one end and to be fixed to the bogie 13 at another end. The blade 22 is located near the bogie 13 in a normal state.

The wheel guiding means is further composed of a gas cylinder 34 with a vertical shaft 31 fixed on the bogie 13 driven by a compressed gas and a gas tank 35 fixed on the bogie 13 to store the compressed gas.

When the abnormal vibration response means 25 and 32 detect an abnormal vibration, the blade 22 is dropped to a position where the blade 22 comes in contact with a side surface of the rail 15 so that the derailed wheel 10 is guided by the wheel guiding means guide.

Similar to the abnormal vibration response means 25 and 32, in the first embodiment, a fixing member 26 may be composed of one end 26*b* fixed to the rolling stock 13 and a flexible joint 26*a* positioned at another end having a receptacle such as a pan-like member.

The rod-like member 23' may be provided with the flexible joint 24 at that top end having a substantially spherical shape and a shock breaker 25 at that middle portion, in which the flexible joint 24 is positioned to face the flexible joint 26*a* and contact freely with an inner surface of the flexible joint 26*a*.

In this embodiment, the abnormal vibration response means 25 and 32 are composed of the shock breaker 25 and the abnormal vibration detection electric sensor 32.

The abnormal vibration detection electric sensor 32 may be composed of a cylindrical sub-cylinder 32*a*, a movable shaft 32*b* positioned within the cylindrical sub-cylinder 32*a* and a compressed spring 32*c*, in which an upper end of the movable shaft 32*b* is connected to a bottom end of a rod-like member 23'. The movable shaft 32*b* is provided with a disk at the bottom end, in which the disk contacts air-tightly with an inner surface of the sub-cylinder 32.

A pair of opposed electric contacts having ring-like shape exc. 32*d* and 32*e* are housed within the sub-cylinder 32, in which one contact 32*d* is positioned at an upper surface within the sub-cylinder 32 and another contact 32*e* is positioned at an upper surface of the disk.

Therefore, when the abnormal vibration response means 25 and 32 detect an abnormal vibration, the rod-like member 23' is fractured by a breakage of the shock breaker 25, the compressed spring 32*c* moves upwardly so that the movable shaft 32*b* moves upwardly so as to close the pair of the contacts 32*d* and 32*e*.

A gas (fluid) cylinder 34 may be composed of a gas (fluid) cylinder 34*a*, a movable shaft 31 capable of moving up or down within the gas cylinder 34*a*, a disk 34*b* fixed on an upper end of the movable shaft 31 to contact air-tightly with an inner surface of the gas cylinder 34*a*, a gas (fluid) inlet 34*c* positioned at an upper end of the gas cylinder 34*a* and a gas (fluid) outlet 34*d* positioned at a bottom end of the gas cylinder 34*a*.

The movable shaft 31 elongates from the bottom of the gas cylinder 34 to the blade 22 so that the movable shaft 31 acts as a supporting member to fix the blade 22.

As shown in FIG. 18A and FIG. 18B, the movable shaft 31, that is, the rod-like supporting member 31 to support the blade 22 is provided with a stopper 31*c* to be fixed on the way of the rod-like support member 31 and a lock mechanism 31*d* capable of opening and closing so that the lock mechanism 31*d* grasps the stopper 31*c* to keep the rod-like support member 31 at predetermined position when the rod-like support member 31 descends.

The blade 22 of the apparatus 100 prevents from the derailment to guide the displaced wheel 10 on the normal running surface of the rail 15 to come in contact with an inner side of the rail 15 (or the border surface between the top surface and the inner side of the rail 15), before the surface FC of the blade 22 come in contact with the most outside of the flange 10*a*.

The lock mechanism 31*d* is fixed on a fixing plate 31*e* and the fixing plate 31*e* is fixed on the bogie 13.

The gas cylinder 34 and the lock mechanism 31*d* may be fixed on the fixing plate 31*e* to be fixed on the bogie 13.

The high pressure gas valve 33 may be provided with a cylinder 33*a*, a movable shaft 33*b* positioned within the cylinder 33*a* having a disk positioned at one end of the movable shaft 33*b*, a disk-like faucet 33*c* positioned at another end of the movable shaft 33*b* and a gas outlet hole 33*d* to connect the compressed gas tank 35 through a piping 38.

The gas outlet hole 33*d* of the high pressure gas valve 33 is connected to the gas inlet hole 34*c* of the gas cylinder 34 through a piping.

The high pressure gas valve 33 is further provided with an electric discharge spark generating device 33*f* such as a pair of discharge electrodes and an explosive 33*g* to be exploded by a discharge from the electric discharge spark generating device 33*f*.

An electric discharge spark generating device 33*f* is positioned at left side of the disk 33*b* within the high pressure gas valve 33 and the explosive 33*g* is placed near the electric discharge spark generating device 33*f*.

When the shock breaker 25 is broken by an abnormal vibration generates, the electric contacts 32*d* and 32*e* are closed so as to supply an electric current from a high voltage power supply 36 to the electric discharge spark generating device 33*f* through an electric wiring 37 so that an electric spark generates.

When the explosive 33*g* within the high pressure gas valve 33 is exploded by the electric spark, the movable shaft 33*b* and the faucet 33*c* move simultaneously so as to open quickly the gas outlet hole 33*d* and the gas inlet hole 34*c* that are closed by the faucet 33*c* in a normal state.

Therefore, at the same time when the shock breaker 25 is broken, a compressed gas from the compressed gas tank 35 is supplied to the gas cylinder 34 through the piping 38 and the high pressure gas valve 33 so that the movable shaft 31 of the gas cylinder 38, or the support member 31 to support the blade 22, is quickly dropped or descended.

FIG. 18A and FIG. 18B are schematic enlarged elevational views showing neighborhood of the lock device.

As shown in FIG. 18A, in a normal state, a wing-like metal fitting 31*c* for use in fixing, fixed to the support member 31 is located at an upper part of a fixing device 31*d* capable of opening and closing with a lateral slide movement.

As shown in FIG. 18B, in an abnormal state, the wing-like metal fitting 31*c* for use in fixing moves downwardly when the rod-like support member 31 is pushed down by the compressed gas supplied into the compressed gas cylinder 34 so that the wing-like metal fitting 31*c* is fixed under the fixing device 31*d* capable of opening and closing with a lateral slide movement.

The fixing device 31*d* may be composed of pins 31*e* movable from side to side by such as spring so that the pins 31*e* moves to both sides of the rod-like support member 31 and the fixing device 31*d* closes to lock the wing-like metal fitting 31*c* after passing the fixing device 31*d*.

Thereby, the rod-like support member 31 unified with the wing-like metal fitting 31*c* and the blade 22 fixed to a bottom end of the rod-like support member 31 are fixed surely at a predetermined position.

As well as in the first embodiment of the invention, in the second embodiment of the invention, when the abnormal vibration response means 25 and 32 detect an abnormal vibration, the derailment protection apparatus 200 can guide the derailed wheel to a normal position on the rail 15 in such a manner that the blade 22 fixed to the bottom end of the support member 31 is descended to a position where the blade 22 comes in contact with the side face of the rail 15 so that the blade 22 guides the wheel 10 to a normal correct position.

A Third Embodiment of the Invention

Figure 19:
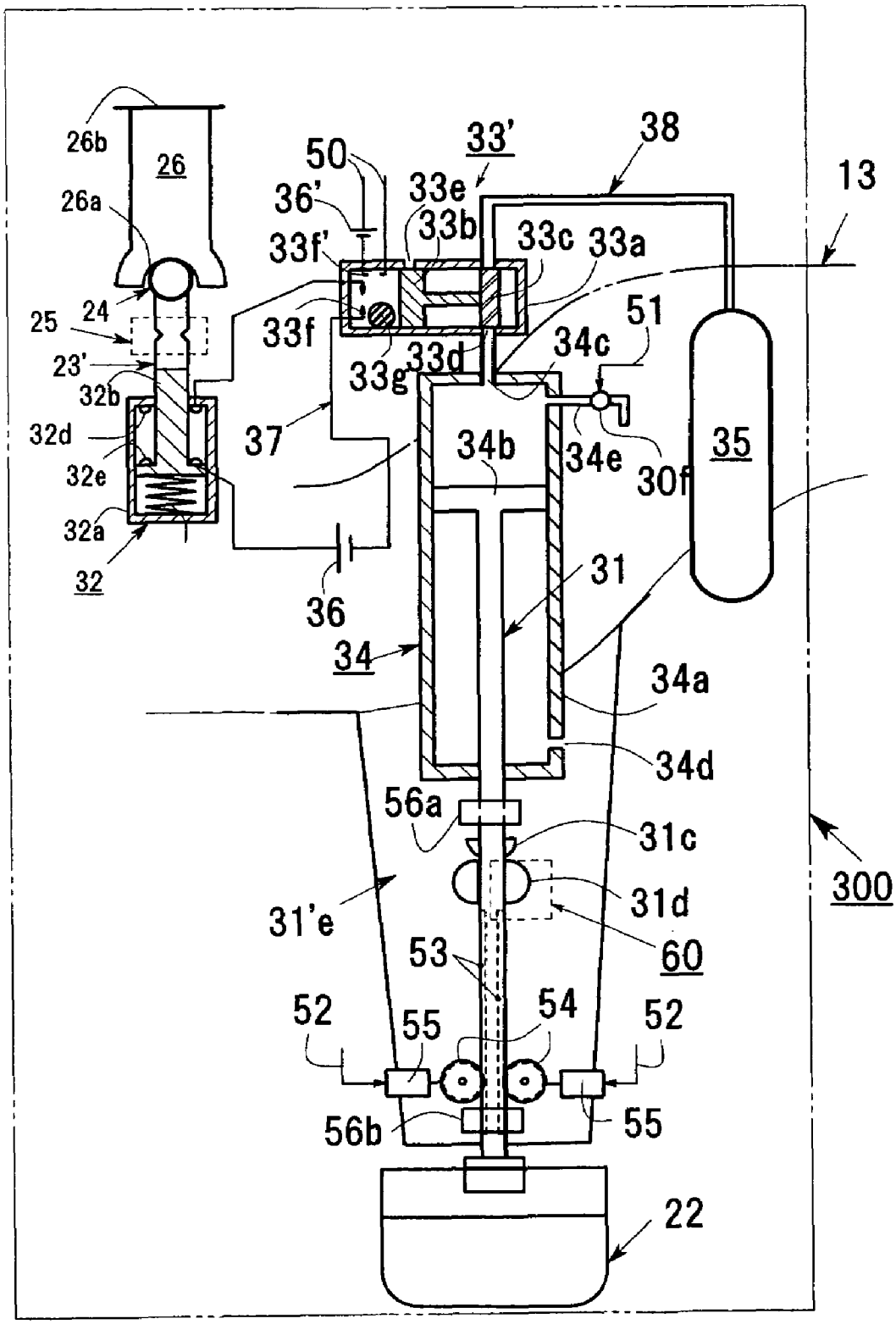
FIG. 19 is a schematic elevational view of the derailment protection apparatus 300 according to a third embodiment of the invention.
Figure 20:
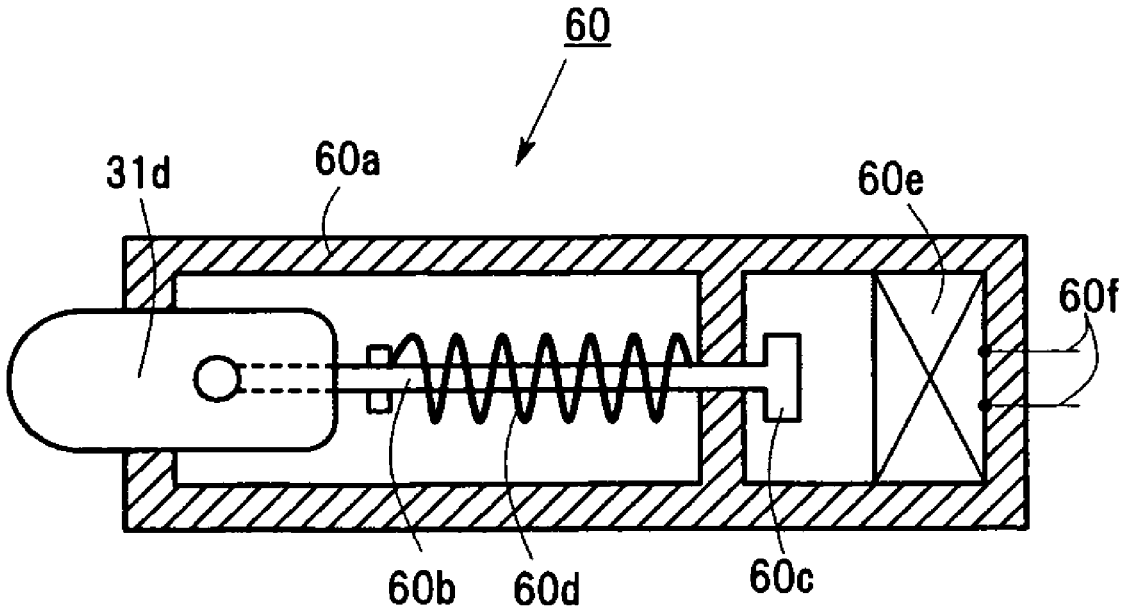
FIG. 20 is a schematic enlarged cross sectional view to show in detail a locking/releasing device 60 in FIG. 19. of the derailment protection apparatus 300 according to a second embodiment of the invention.
Figure 21:
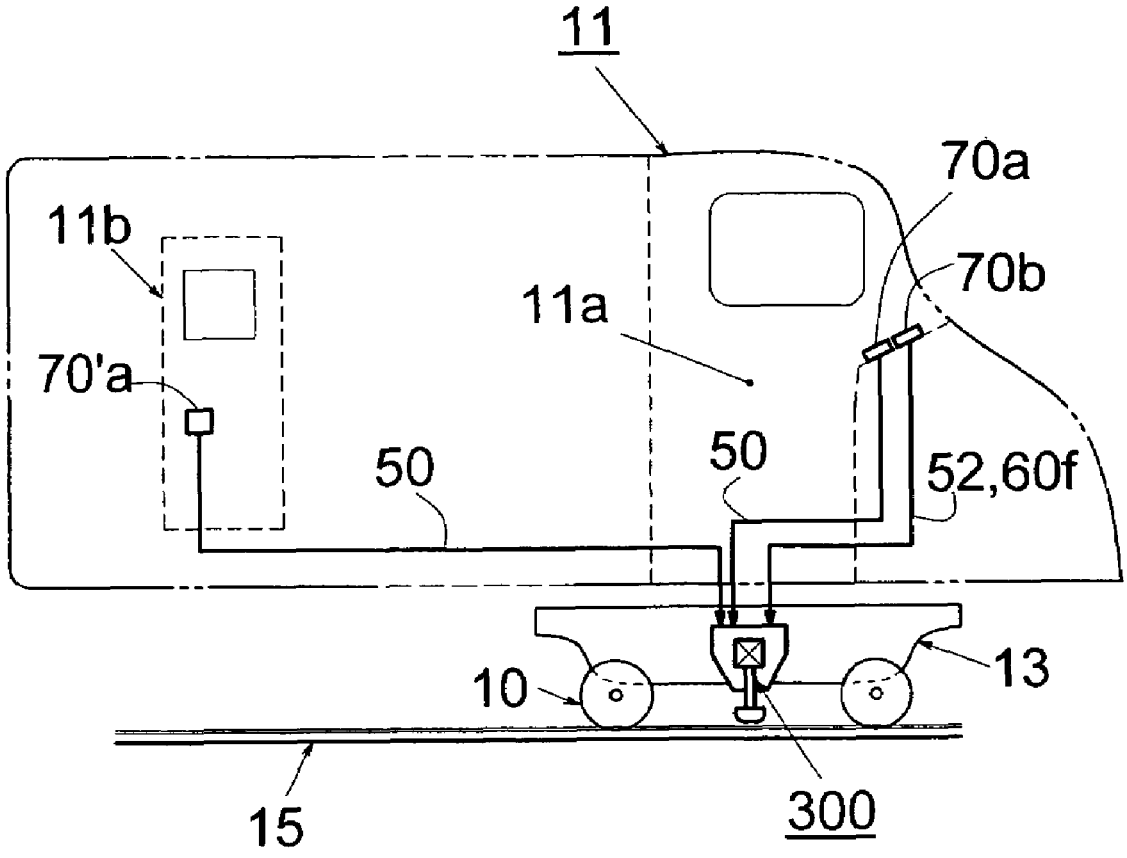
FIG. 21 is a schematic elevational view to show the rolling stock and the bogie, wherein the derailment protection apparatus 300 and wiring system.

Referring to FIG. 19, FIG. 20 and FIG. 21, the third embodiment of the present invention are explained as follows.

FIG. 19 is a schematic elevational view of the derailment protection apparatus 300 according to the third embodiment of the present invention.

As shown in FIG. 19, a derailment protection apparatus 300 may be composed of a locking/releasing device 60 and a lifting device 53 and 54 in addition to the derailment protection apparatus similar to the derailment protection apparatus 200.

In an explanation referring to FIG. 19, the explanation regarding to the same (common) elements denoted as the same reference numerals as FIG. 17 is as much as omitted. Therefore, please refer to the before-mentioned explanation referring to FIG. 17 regarding such common elements.

The high pressure gas valve 33' may be provided with a cylinder 33*a*, a movable shaft 33*b* positioned within the cylinder 33*a* having a disk positioned at one end of the movable shaft 33*b*, a disk-like faucet 33*c* positioned at another end of the movable shaft 33*b* and a gas outlet hole 33*d* to connect the compressed gas tank 35 through a piping 38.

The gas outlet hole 33*d* of the high pressure gas valve 33 is connected to the gas inlet hole 34*c* of the gas cylinder 34 through a piping.

The high pressure gas valve 33' is further provided with the electric discharge spark generating device 33*f*, an additional electric discharge spark generating device 33*f'* and the explosive 33*g* to be exploded by a discharge from the electric discharge spark generating devices 33*f* or 33*f'*.

The electric discharge spark generating device 33*f* and 33*f'* are positioned at left side of the disk 33*b* within the high pressure gas valve 33'.

The explosive 33*g* is placed near the electric discharge spark generating devices 33*f* and 33*f'*.

The additional electric discharge spark generating devices 33*f'* is connected to manual switches 70*a* and 70*a*'within a driver's cab 10*a* and a conductor's room 10*a*' through a pair of electric wires 50 (refer to FIG. 21 as well as FIG. 19).

An additional electric power source 36' is inserted in one of the electric wires 50.

For an easy lifting up of the wheel guiding member 22, it is necessary to exhaust the gas remaining within the cylinder 34 that is filled when the derailment protection apparatus 300 has been activated. For this purpose, an electric valve 34*f* and an exhaust pipe 34*c* are provided in an upper part of the cylinder 34.

The electric valve 34*f* is controllable from the switch 70*b* in the driver's cab 10*a* in FIG. 21 through a wiring 51.

After the derailment protection apparatus 300 has been activated by an abnormal force, the locking/releasing device 60 can release the stopper 31*d* to fix and lock the shaft 31, then an emergency situation finishes so that the driver can drive again the rolling stock.

The lifting device may be mainly composed of a combination of racks 53 and pinions 54 and motors 55 that are positioned under the locking/releasing device 31*c* and 31*d*.

The rack 53 is a rack-like teeth formed on a surface of the movable shaft 31. The pinion 54 is a pair of gears capable of coupling mechanically with the rack 53 of the movable shaft 31. The pinion 54 is fixed on the fixing plate 31"*e* fixed on the bogie 13. The pinion 54 is positioned on the fixing plate 31"*e* fixed on the bogie 13.

The pinions 54 are moved by the motors 55 with lead wires 52 to supply an electric current.

The lifting device 53, 54 and 55 lifts up the shaft 31 unlocked by the locking/releasing device 60 to an original position before activation of the derailment protection apparatus.

FIG. 20 is a schematic enlarged cross sectional view to show in detail a locking/releasing device 60 in FIG. 19.

As shown in FIG. 20, the locking/releasing device 60 may be composed of a cylinder 60*a*, a movable shaft 60*b* in the cylinder 60*a*, the stopper 31*d* fixed to an end of the cylinder 60*a*, a magnetic disk 60*c* fixed to another end of the cylinder 60*a* and an electromagnet 60*e* housed in an end of the cylinder 60*a*.

The magnetic disk 60*c* moves to a direction of the electromagnet 60*e* when the an electric current is supplied to the electromagnet 60*e* through electric wires 60*f*.

At the same time, the stopper 31*d* is released, because the movable shaft 60*b* and the stopper 31*d* move to right in FIG. 20.

Therefore, the movable shaft 31 and the wheel guiding member 22 enable to lift up to that original position.

FIG. 21 is a schematic elevational view to show the rolling stock and the bogie, wherein the derailment protection apparatus 300 and a wiring system;

As shown in FIG. 21, a first switch 70*a*, a second switch 70*b* may be provided in a driver's cab 10*a* of the rolling stock 11, and a third switch 70"*a* may be provided in a conductor's room 10.

The first switch 70*a* and the third switch 70"*a* are connected respectively to the discharge electrodes 33*f'* in FIG. 19 via a wiring 50 installed in the rolling stock 11.

Therefore, in an emergency situation, before the sensors (26*a* and 24) and/or 25 activate, a driver or a conductor enables manually to activate the motor 55 with the first switch 70*a* and/or the third switch 70"*a* so as to lift down the wheel guiding member 22.

The second switch 70*b* is connected respectively to the motors 52 in FIG. 19 and the electromagnet 60*e* in FIG. 20 via wirings 52 and 60*f* installed in the rolling stock 11.

The lifting device 53, 54 and 55 in FIG. 19 can lift up the wheel guiding member 22 with the switch 70 *b* on a control panel in the driver's cab 10*a* of the rolling stock 11 through the wiring 52.

Even if the derailment protection apparatus 300 does not activate at an emergency due to failure of a gas supply system etc., it is possible also to activate electrically the lifting device 53, 54 and 55 in such a manner that the movable shaft 31 and the wheel guiding member 22 may be descended by supplying an electric current with an opposite polarity to the motor 55 according to the driver's operation.

The derailment protection apparatus 300 is made of a strong material and with a sufficient thickness.

Further, the wheel guiding member (blade) 22 is preferably fixed strongly and securely to the supporting plate 31*e'*.

For this purpose, at least one reinforcement member such as metal fittings 56*a* and 56*b* is preferably provided to position on the supporting plate 31*e'*.

The metal fittings 56*a* and 56*b*, each has a through hole to allow the movable shaft 31 to pass the through hole.

The wing-like members 31*c* in FIG. 19 may substitute for at least one cylindrical or disk-like member with a through hole to increase a strength.

A Modification of Wheel Guiding Member

Referring to FIG. 22 through FIG. 25, a modification of the wheel guiding member 22 and 40 as shown in FIG. 8 is explained.

Figure 22:
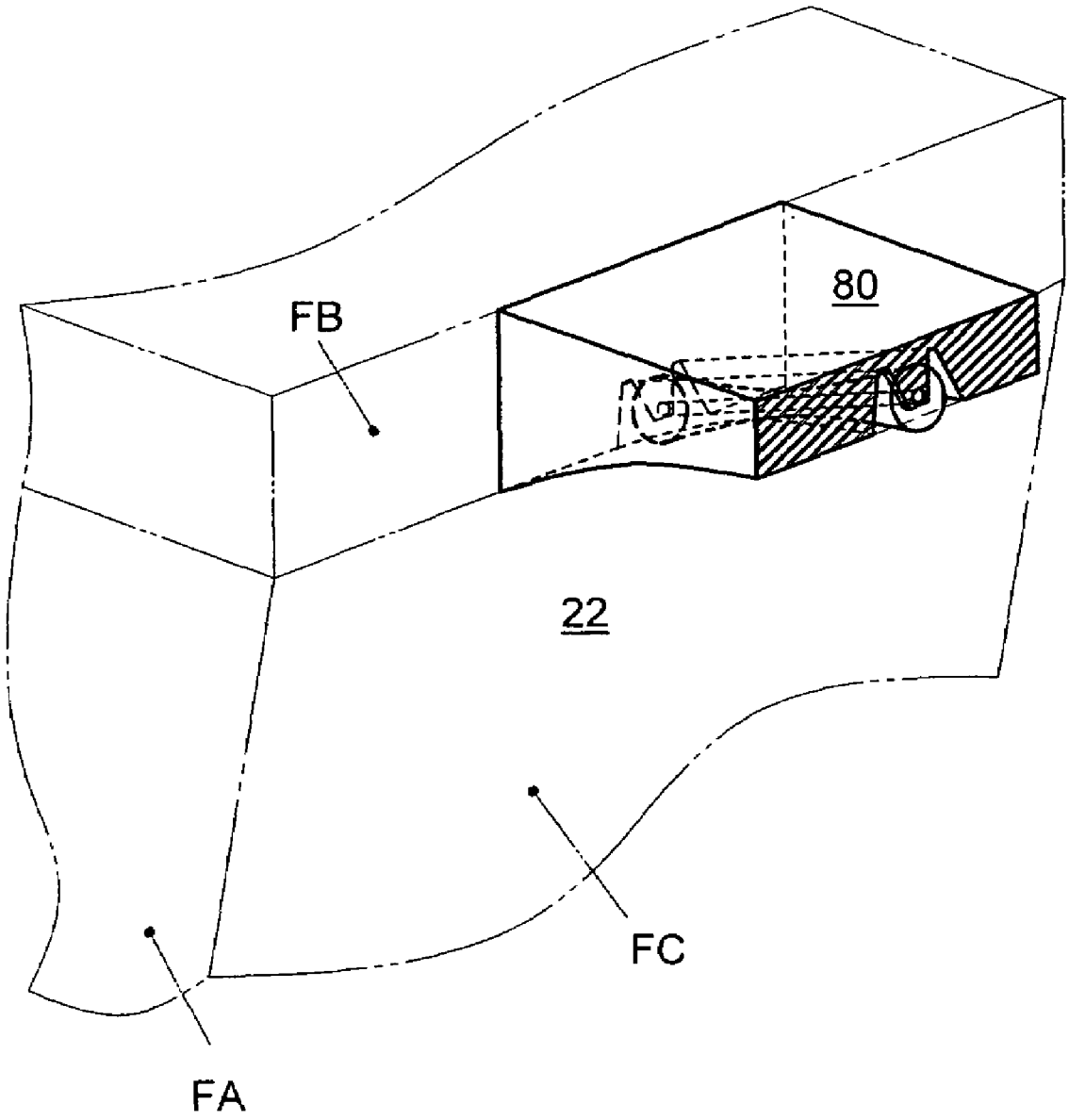
FIG. 22 is a schematic perspective view to show a modification of the wheel guiding member.

FIG. 22 is a schematic perspective view to show a second wheel guiding member 80 to modify the second wheel guiding member 40 in FIG. 8.

Figure 23:
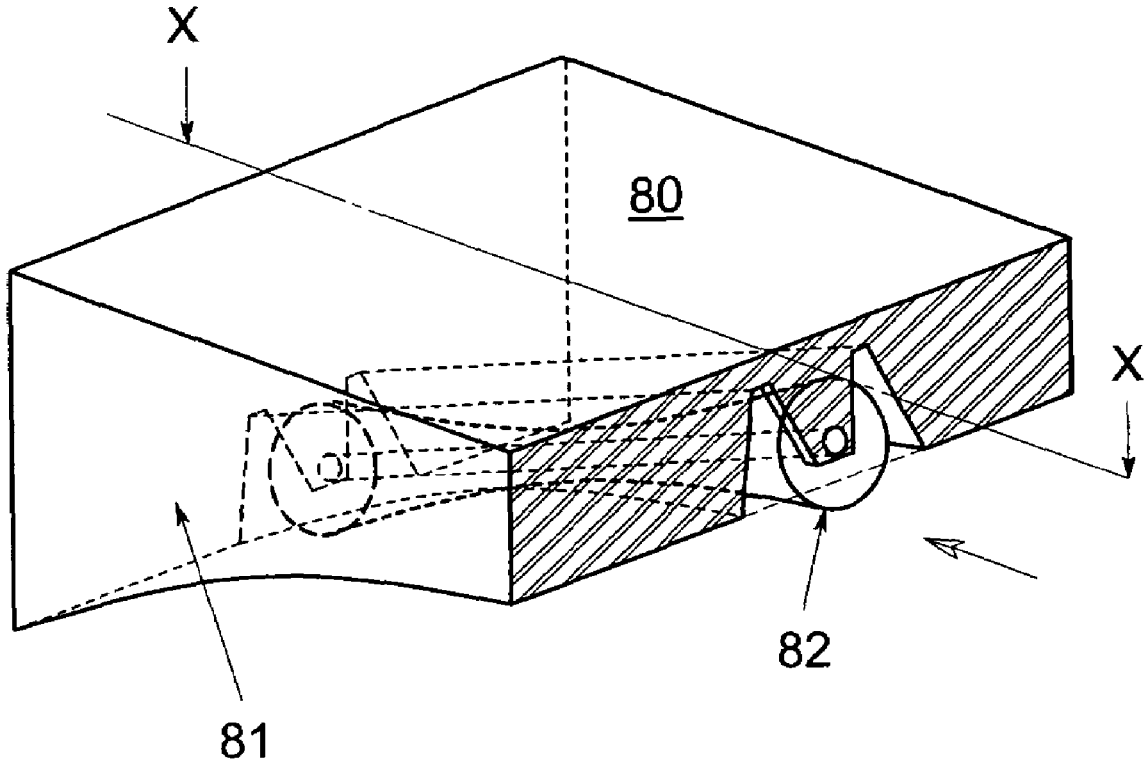
FIG. 23 is a schematic enlarged perspective view to show a second wheel guiding portion 80 in FIG. 22.

FIG. 23 is a schematic enlarged view to show the second wheel guiding member 80.

Figure 24:
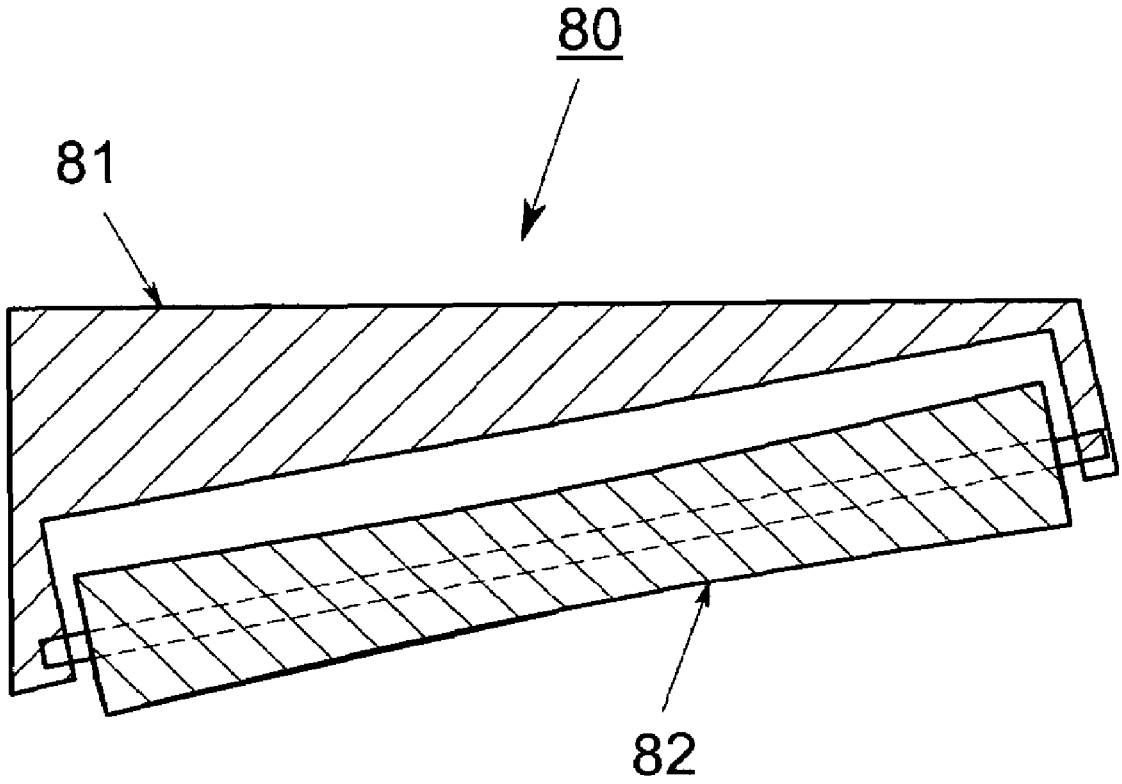
FIG. 24 is a schematic enlarged cross sectional view taken along a line X-X in FIG. 23 to show the second wheel guiding portion 80.

FIG. 24 is a schematic cross sectional view taken along the line X-X in FIG. 23.

Figure 25:
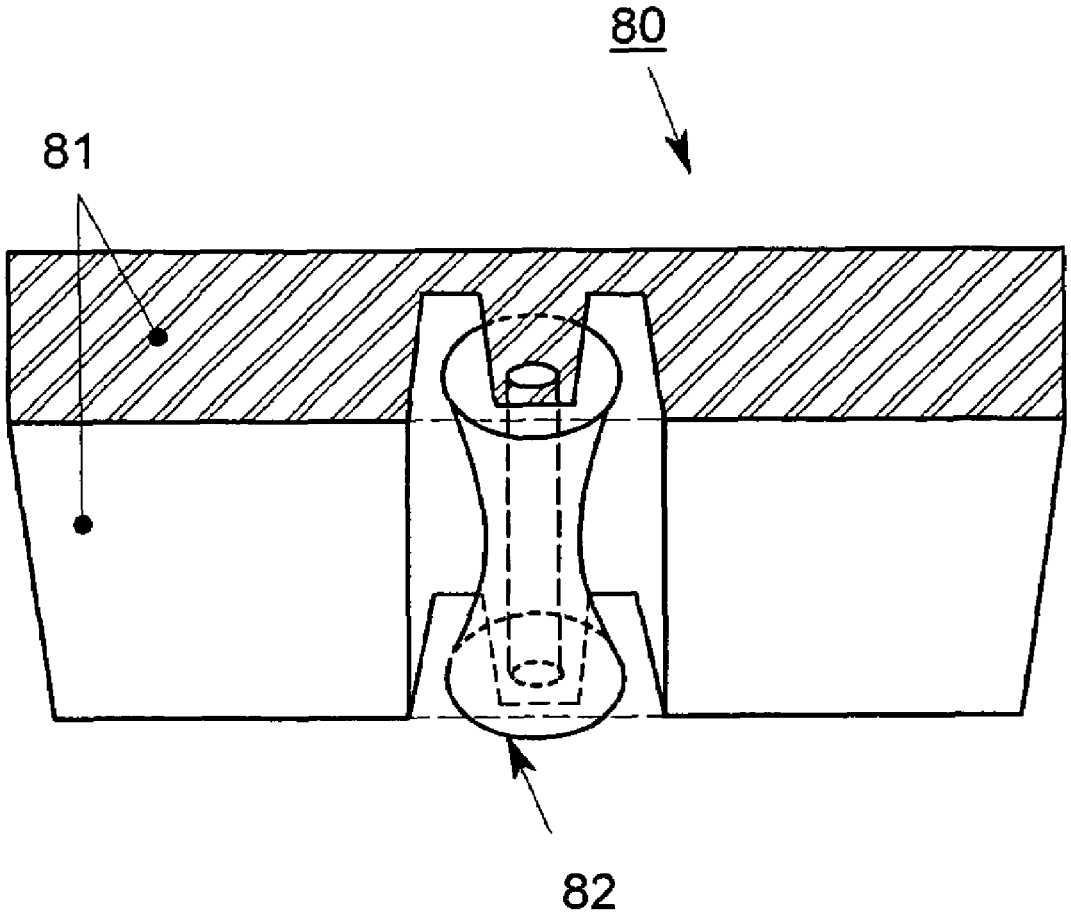
FIG. 25 is a schematic enlarged side view to show the second wheel guiding portion 80 seeing from an arrow direction in FIG. 23.

FIG. 25 is a schematic elevational view to observe from an arrow in FIG. 23.

The second wheel guiding member 80 may be more effective for high speed running of the rolling stock than the second wheel guiding member 40 to return the wheel that is deviated from the rail to an original position on the rail.

In FIG. 23 and FIG. 25, the second wheel guiding member 80 is composed of a main body 81 and a rotate-able roller 82 positioned in a center of the main body 81

The roller 82 is formed as a substantially conical shape having an inclined surface and expanded both ends.

When the derailment protection apparatus 100, 200 or 300 is activated, the inclined surface of the roller 82 rotates at a high speed so that the wheel going to derail returns smoothly on the rail.

The main body 81 of the second wheel guiding member 80 protrudes outwardly from the first wheel guiding member (blade) 22.

The first and second wheel guiding members 22 and 80 are preferably unified into a single structure as shown in FIG. 23.

The inclined outer surface of the roller 82 is positioned downwardly from an inclined bottom surface of the main body 81, so that a friction between the inclined bottom surface and the rail is decreased due to rotation of the roller 82.

Another Modification of Rail Guiding Member

Figure 26:
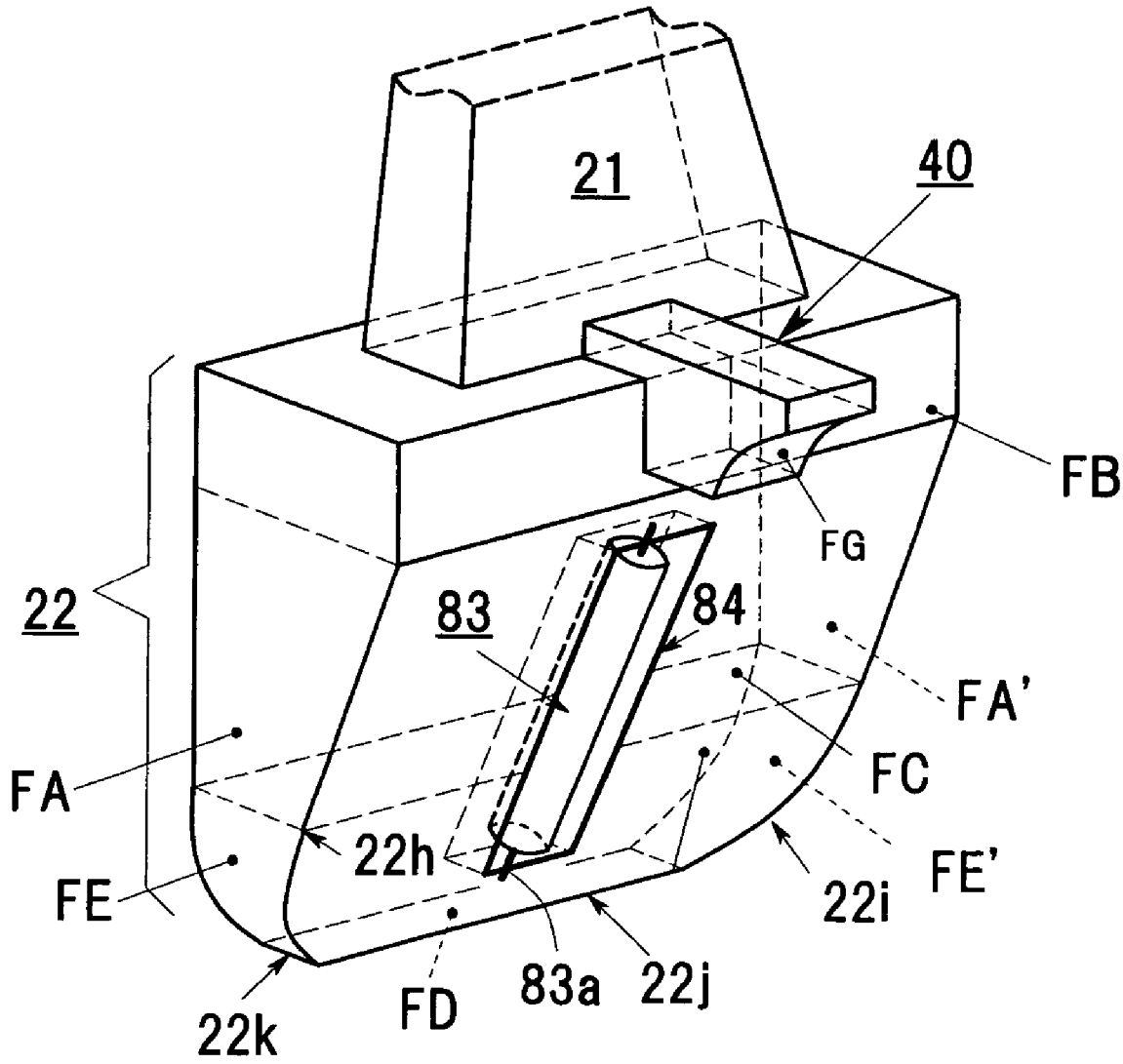
FIG. 26 is a schematic perspective view of a modified rail guiding member rail guiding member that is another modification of the rail guiding member 22 and 40 shown in FIG. 8.

Referring to FIG. 26, another modification of the rail guiding member 22 and 40 is described below.

FIG. 26 is a schematic perspective view of a modified rail guiding member that is another modification of the rail guiding member 22 and 40 shown in FIG. 8.

As shown in FIG. 26, similarly explained in FIG. 8, a first wheel guiding member (or a rail contact member) 22 is composed of an inclined surface FC having an inclined structure, in which an inclination of the inclined surface FC elongates downwardly toward an inside of a pair of the rails.

A substantially cylindrical shaft 83*a* is inserted into a substantially tubular roller 83 in that center through hole.

The tubular roller 83 is housed in a substantially rectangular groove 84 formed in the inclined surface FC.

Both ends of the cylindrical shaft 83*a* are securely fixed to the first wheel guiding member 22.

The tubular roller 83 is slightly protruded from the inclined surface FC.

When the derailment apparatus 100, 200 or 300 starts to operate, the tubular roller 83 is contacted with the rail, so that a wheel to be displaced from a normal running surface of the rail can be guided and returned to the normal running surface by a high speed rotating of the tubular roller 83.

A Fourth Embodiment of the Invention

Referring to FIG. 27 to FIG. 30, the fourth embodiment of the invention is explained below.

Figure 27:
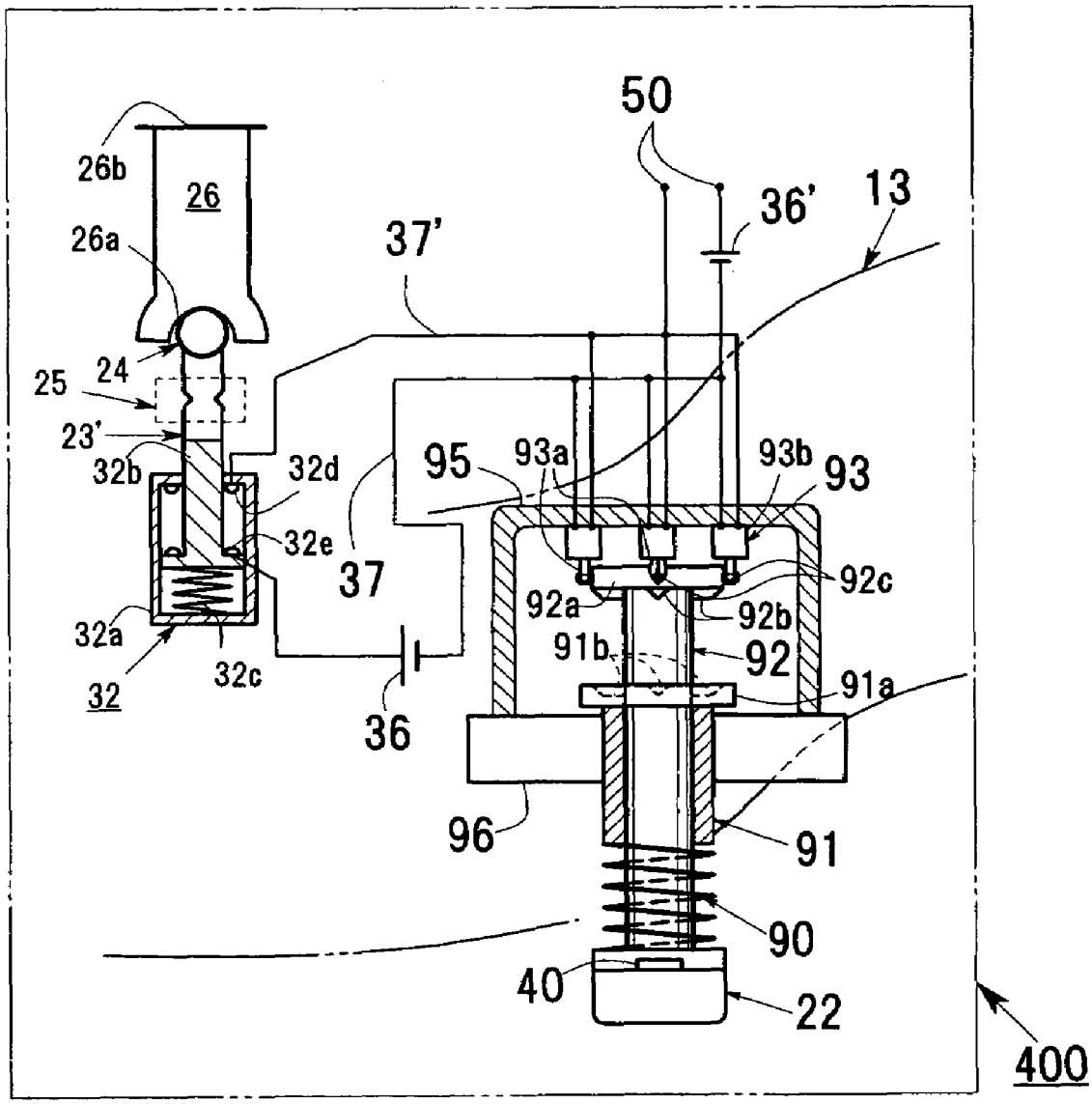
FIG. 27 is a schematic elevational view of the derailment protection apparatus 400 according to the fourth embodiment of the invention.

FIG. 27 is a schematic elevational view of the derailment protection apparatus 400 according to the fourth embodiment of the invention.

Figure 28:
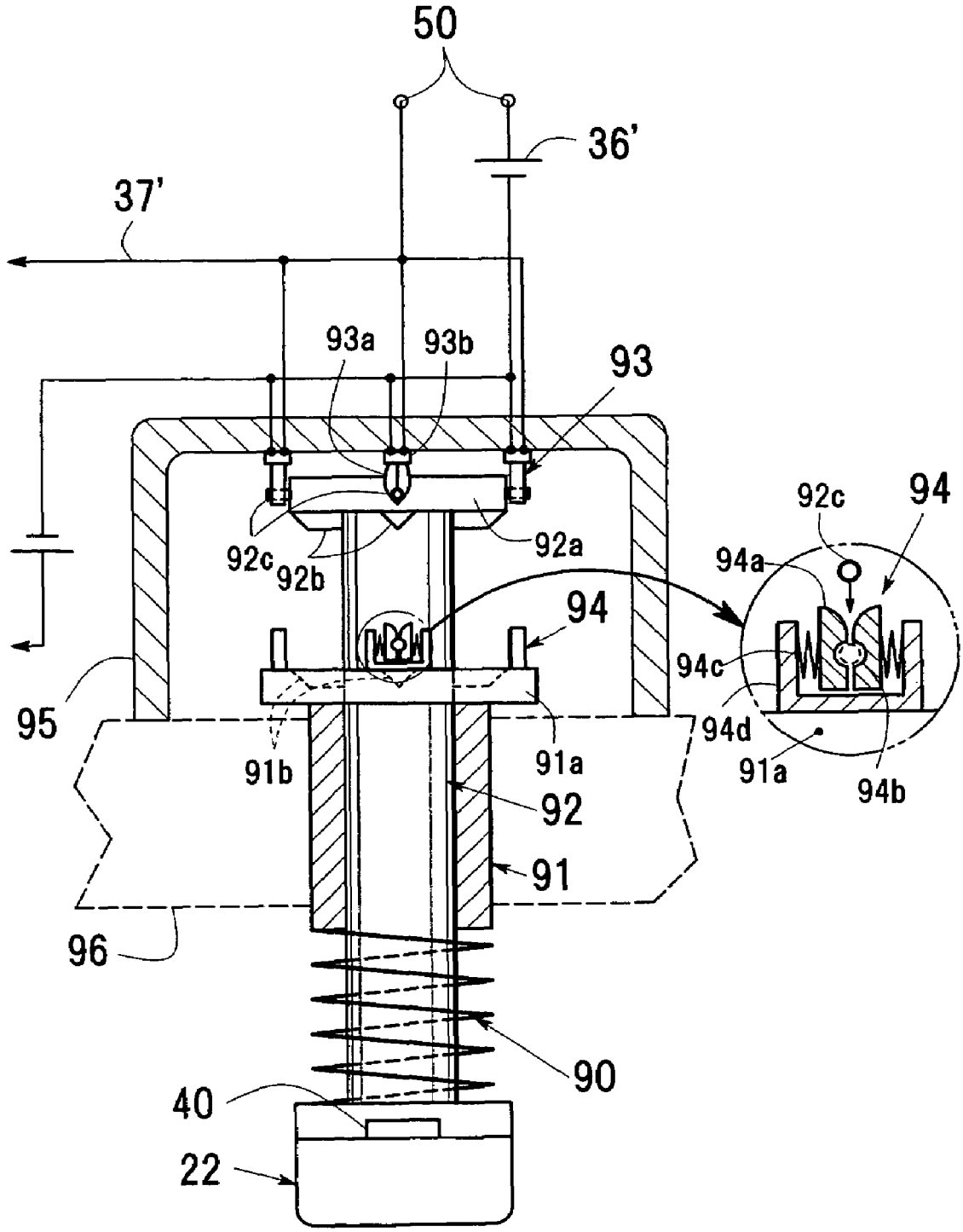
FIG. 28 is a schematic enlarged elevational view of a portion in FIG. 27 showing an un-operating state of a wheel guiding device.

FIG. 28 is a schematic enlarged elevational view of a portion in FIG. 27 showing an un-operating state of a wheel guiding device.

Figure 29:
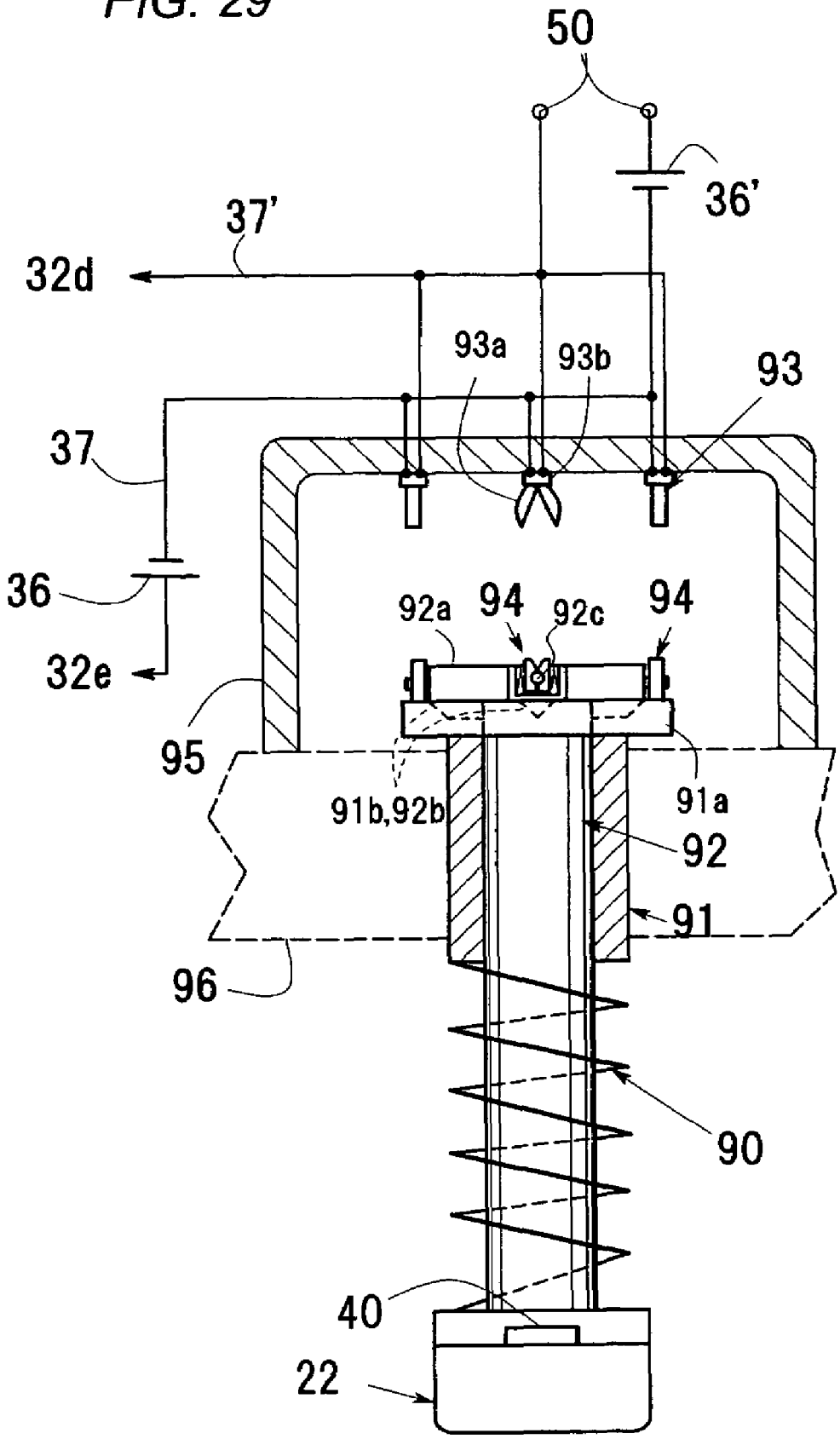
FIG. 29 is a schematic enlarged elevational view of a portion in FIG. 27 showing an operating state of the wheel guiding device.

FIG. 29 is a schematic enlarged elevational view of a portion in FIG. 27 showing an operating state of the wheel guiding device.

Figure 30:
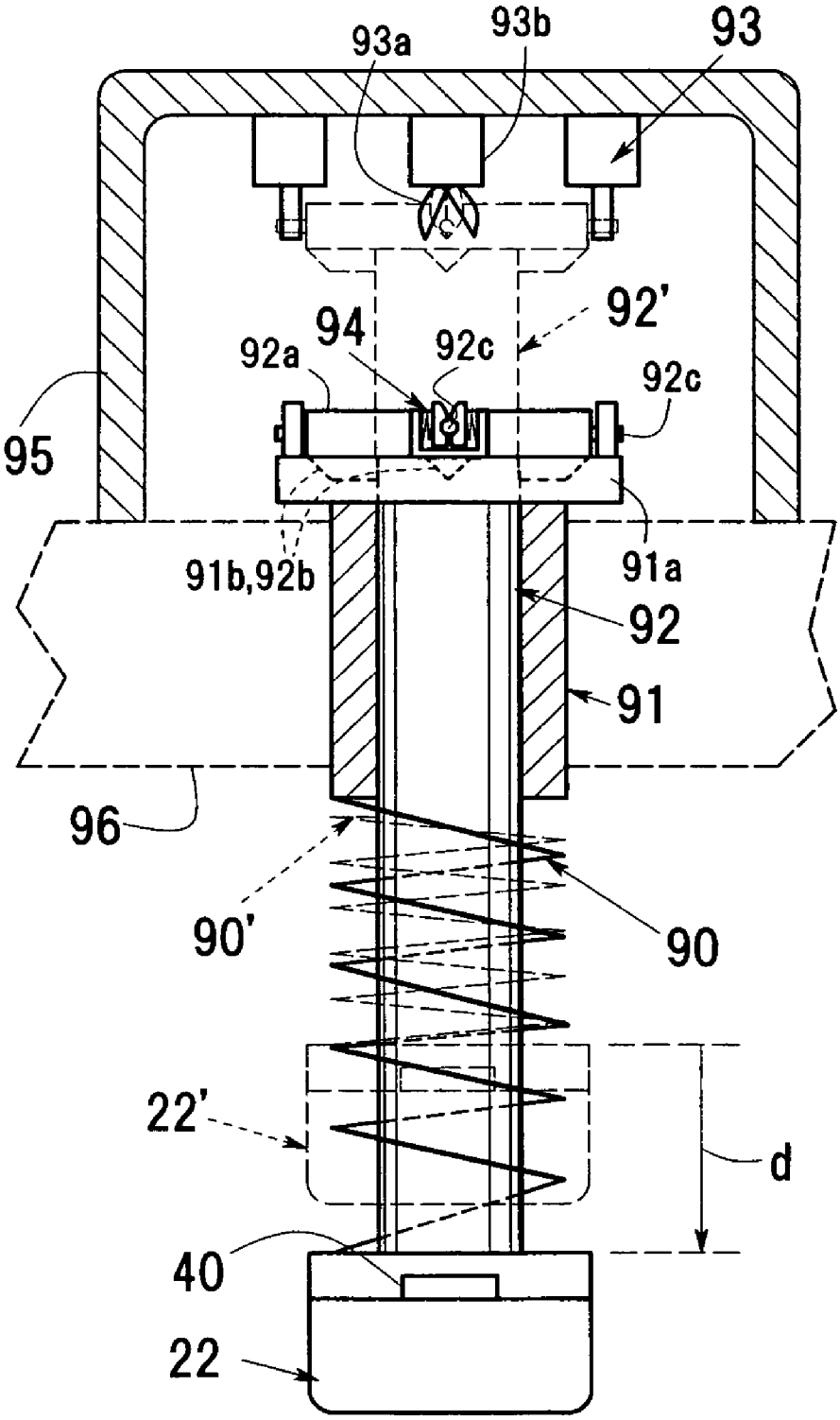
FIG. 30 is a schematic enlarged elevational view of the wheel guiding device showing both of an un-operating state and an operating state.

FIG. 30 is a schematic enlarged elevational view of the wheel guiding device showing both of an un-operating state and an operating state.

In the following explanation of the derailment protection apparatus 400 according to the fourth embodiment of the invention, the explanation duplicated with the embodiments explained before may be omitted as much as possible.

As shown in FIG. 27, the derailment protection apparatus 400 in the fourth embodiment briefly composed of an abnormal vibration responsive device 25 and 32 and a wheel guiding device 90, 91 and 92 having a wheel guiding member 22 and 40.

The abnormal vibration responsive device 25 and 32 is composed of a shock breaker 25 and an abnormal vibration detection electric sensor 32.

The abnormal vibration detection electric sensor 32 may be composed of a cylindrical sub-cylinder 32*a*, a movable shaft 32*b* positioned within the cylindrical sub-cylinder 32*a* and a compressed spring 32*c*, in which an upper end of the movable shaft 32*b* is connected to a bottom end of a rod-like member 23'.

The movable shaft 32*b* is provided with a disk at the bottom end, in which the disk contacts air-tightly with an inner surface of the sub-cylinder 32*a*.

A pair of opposed electric contacts 32*d* and 32*e* having ring-like shape exc. are housed within the sub-cylinder 32, in which one contact 32*d* is positioned at an upper surface within the sub-cylinder 32 and another contact 32*e* is positioned at an upper surface of the disk.

Therefore, when the abnormal vibration response means 25 and 32 detect an abnormal vibration, the rod-like member 23' is fractured by a breakage of the shock breaker 25, the compressed spring 32*c* moves upwardly so that the movable shaft 32*b* moves upwardly so as to close the pair of the contacts 32*d* and 32*e*.

As shown in FIG. 27 to FIG. 30, the wheel guiding device in the derailment protection apparatus 400 is composed of a cylindrical member 92, a tubular member (i.e. guiding pipe) 91, a coil spring 90, at least one lock device 93 positioned at an upper portion of the cylindrical member 92 and the wheel guiding member (or a rail contact member) 22 with an inclined surface fixed to a lower portion of the cylindrical member 92.

The tubular member (i.e. guiding pipe) 91 is fixed to a bogie 13 and guides the cylindrical member 92 to move up and down.

The coil spring 90 is provided around the central shaft of the cylindrical member 92.

The lock device 93 locks to hold an upper portion of the cylindrical member 92 in a normal state, and, in an abnormal state, the lock device 93 unlocks to release the upper portion of the cylindrical member 92.

The cylindrical member 92 is provided with a disk 92*a* at that upper portion.

The disk 92*a* of the cylindrical member 92 has preferably such trapezoidal shape in cross section that a diameter of that top surface is larger than the diameter of that bottom surface.

The disk 92*a* is provided with a plurality of protrusions (convexes) 92*b* at that lower surface.

A plurality of pins 92*b* protrudes laterally from a side surface of the disk 92*a*.

In FIG. 27 to FIG. 30, a fixing member 95 is provided to fix the electromagnetic lock device 93 at that upper portion, in which the fixing member 95 having a substantially "C" like shape of a character is fixed at that lower portion on the bogie 13 via the fixing plate 96.

The tubular member (i.e. guiding pipe) 91 is fixed to the bogie 13 via the fixing plate 96.

The tubular member (i.e. guiding pipe) 91 has is a through hole to insert the cylindrical member 92, so that the cylindrical member 92 can move up and down in the through hole of the tubular member 92.

The tubular member 91 and the cylindrical member 92 have preferably a mechanism to guide the wheel guiding member 22 toward a correct direction.

The above mechanism may be such a combination that one of the members 91 and 92 has a linear protrusion along that length another has a linear groove corresponding to the linear protrusion.

A ring-like member 91*a* acting as a stopper and a lock is fixed on a top surface of the tubular member (i.e. guiding pipe) 91.

The ring-like member 91*a* may have a circular hole with a diameter larger than the diameter of the tubular member (i.e. guiding pipe) 91.

The ring-like member 91*a* has a plurality of grooves (concaves) 91*a* on that upper surface.

The grooves (concaves) 91*a* may have a triangular shape opposite to the shape of the protrusions (concaves) 92*b* to fit each other.

The grooves (concaves) 91*a* can receive the protrusions (concaves) 92*b*, when the cylindrical member 92 descends so that the cylindrical member 92 is stopped strongly at a predetermined position and fixed at the ring-like member 91*a* to keep that position.

Similarly to the electromagnetic lock device 29 as shown in FIG. 7, the electromagnetic lock device 93 is composed of a pair of finger-like members 93*a* and an electromagnetic coil 93*b* to open and close the finger-like members 93*a*.

An end of the electromagnetic coil 93*b* is connected to an electric contact 32*e* of the abnormal vibration detection electric sensor 32 through an electric wiring 37 and a power source 36 to energize the coil 93*b*.

Another end of the electromagnetic coil 93*b* is connected to another electric contact 32*d* of the abnormal vibration detection electric sensor 32 through another electric wiring 37'.

The lock devices 94 may be composed of a locking member 94*d* fixed on the ring-like member 91*a*, a pair of finger-like members 94*a* to receive and lock the pins 92*c* of the disk 92*a* and a pair of springs to push the finger-like members 94*a*.

A half circular groove 94*b* may be formed on an inner side surface of each finger-like member 94*a* to receive and lock the pin 92*c*.

An electromagnetic releasing device (not shown in FIG. 31) may be provided with the lock device 94 capable of releasing the lock device 94 electrically by a driver from a driver's cab.

As shown in FIG. 28, the cylindrical member 92 is ascended to a position of the electric magnetic coil 93*b* fixed to a top portion of the fixing member 95 to compress fully the coil spring 90.

The cylindrical member 92 is kept at an upper position in a normal state, in such a manner that the pins 92*c* of the disk 92 are held by gripping (closing) the finger-like members 93*a*.

As shown in FIG. 27 and FIG. 29, in an abnormal state, the finger-like members 93*a* are opened or released by energizing the electromagnetic coil 93*b*, when the electric contacts 32*d* and 32*e* of the abnormal vibration detection electric sensor 32 are closed.

Therefore, when the finger-like members 93*a* are opened, the cylindrical member 92 and the wheel guiding member (rail contact member) 22 fixed on a bottom of the cylindrical member 92 are dropped immediately mainly by a restoring power of the coil spring 90 and a weight of the cylindrical member 92.

As shown as FIG. 30, the wheel guiding member (rail contact member) 22 descends mainly by a distance "d" and is kept in that position.

FIG. 30 shows a positioning of the cylindrical member 92 and 92', the coil spring 90 and 90' and the wheel guiding member (rail contact member) 22 and 22' and a opened or closed state of lock device 93.

In FIG. 30, the positioning of the cylindrical member 92, the coil spring 90' and the wheel guiding member 22 illustrates the abnormal state and the positioning of the cylindrical member 92', the coil spring 90' and the wheel guiding member 22' illustrates the normal state.

These three members in the abnormal state are drawn by continuous lines, while the three members in the normal state are drawn with chain lines (dotted lines).

As shown in FIG. 30, the wheel guiding member (rail contact member) 22 in the abnormal state descends by a distance "d" compared with the wheel guiding member (rail contact member) 22'.

Therefore, when the lock device 93 is released, the wheel guiding member having the inclined surface is forced to be descended mainly by a restoring power of the coil spring and the inclined surface and the rail contacts together.

Thereby, the wheel going to displace from the rail is protected from a derailment and the wheel is guided on a normal running surface of the rail by the inclined surface to contact the rail.

At the same time, the running bogie (rolling stock) is decreased in that speed or stopped by a friction of contact between the inclined surface and the rail.

The derailment protection apparatus 200, 300 and 400 mentioned hereinbefore can be operated electrically to handle the switch 70*a*, 70"*a*, 70*b* by a driver or conductor in the driver's cab 11*a* or the conductor's room 11*b* as shown in FIG. 21.

A Fifth Embodiment of the Invention

Figure 31:
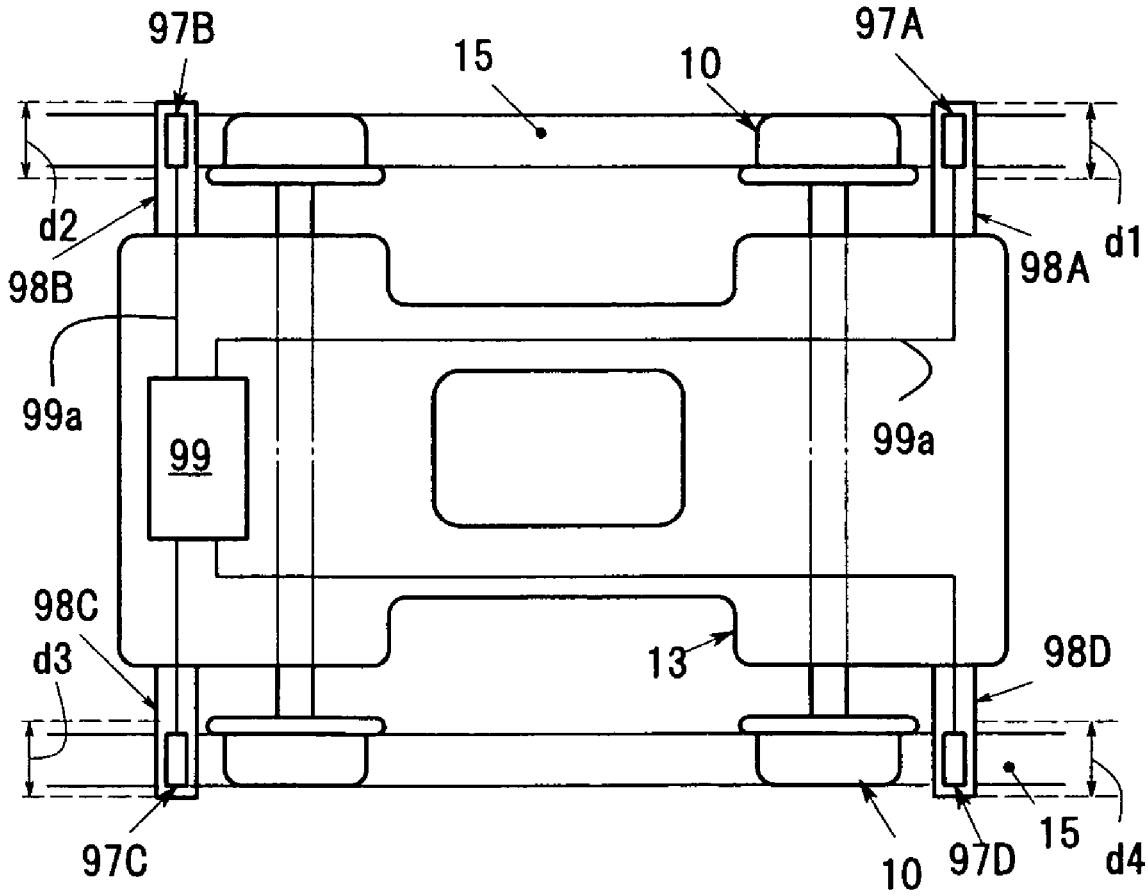
FIG. 31 is a schematic plane view of a derailment protection apparatus according to the fifth embodiment of the invention.
Figure 32:
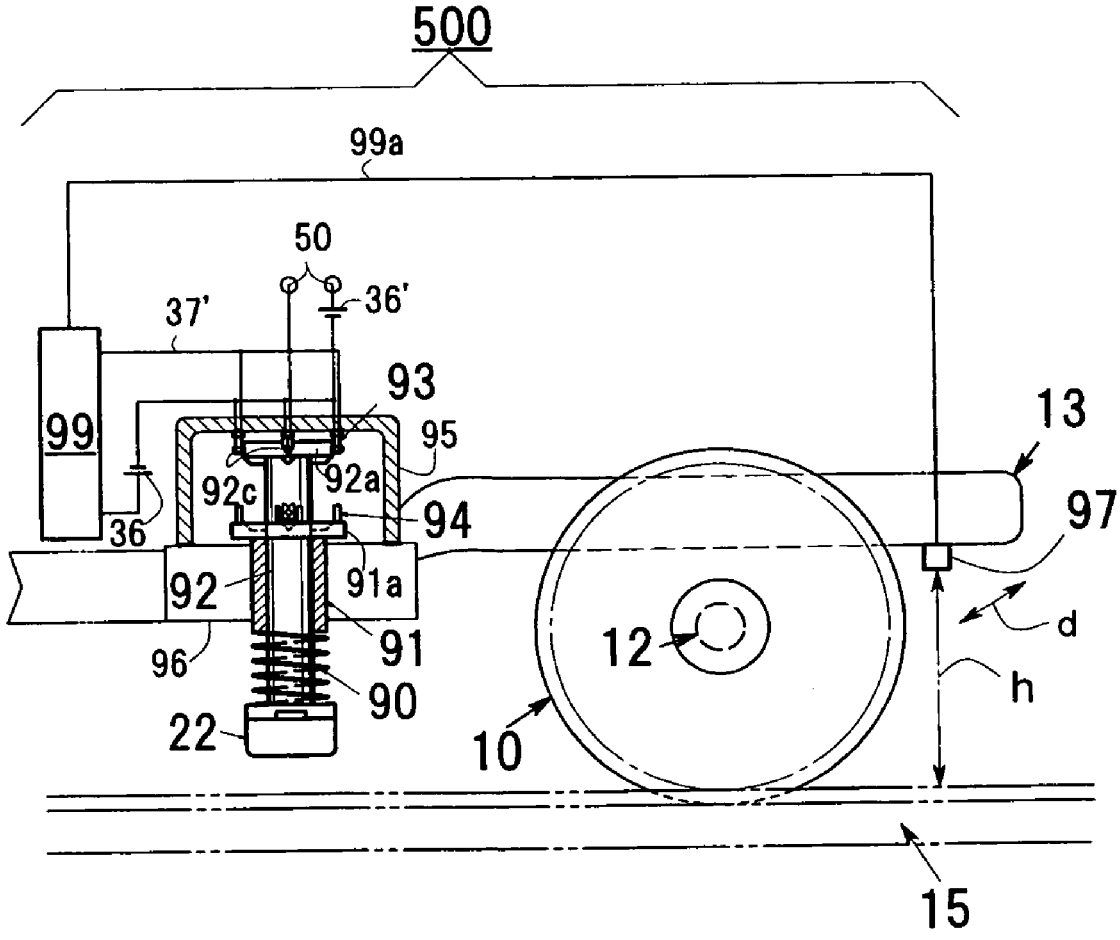
FIG. 32 is a schematic elevational view of the derailment protection apparatus according to the fifth embodiment of the invention.

Referring to FIG. 31 to FIG. 32, the fifth embodiment of the invention is explained below.

FIG. 31 is a schematic plane view of a derailment protection apparatus according to the fifth embodiment of the invention.

FIG. 32 is a schematic elevational view of the derailment protection apparatus according to the fifth embodiment of the invention.

Referring to FIG. 31 and FIG. 32, a derailment protection apparatus 500 is composed of a wheel guiding device (90, 91, 92, 93 and 22) and an abnormal vibration detecting device.

The abnormal vibration detecting device is composed of an abnormal vibration sensors 97 (97A, 97 B, 97C and 97D) to detects a vibration and a control circuit 99 to control wheel guiding devices 90, 91, 92, 93 and 22.

The control circuit 99 sends an electric power to the abnormal vibration sensor 97 through electric wirings 99*a*.

An electric signal from the abnormal vibration sensor 97 sends to the control circuit 99 through electric wirings 99*a*.

The wheel guiding devices 90, 91, 92, 93 and 22 in the fifth embodiment is similar to the wheel guiding devices 90, 91, 92, 93 and 22 in the fourth embodiment as described before.

The wheel guiding devices 90, 91, 92, 93 and 22 in the fifth embodiment is composed of a cylindrical member 92, a tubular member (guiding tube) 91, a coil spring 90 compressed normally, a lock device 93 and a wheel guiding member (a rail contact member) 22.

The wheel guiding member (rail contact member) 22 having an inclined surface is fixed to a bottom end of the cylindrical member 92.

The abnormal vibration sensors 97 (97A, 97 B, 97C and 97D) are fixed on fixing members 98 (98A, 98B, 98C and 98D).

The fixing members 98 (98A, 98B, 98C and 98D) are fixed to right and left parts of front and back portions in a bogie 13.

The abnormal vibration sensors 97 (97A, 97 B, 97C and 97D) are composed of energy beam emitting elements to emit energy beam and energy beam receiving elements to receive the energy beam reflected from rails 15.

The energy beam emitting elements are preferably composed of semiconductor light emitting elements such as light emitting diodes (LED's) and laser diodes (LD's) to emit light beam including ultraviolet rays, visible light rays or infrared rays.

The energy beam receiving elements are preferably composed of semiconductor light receiving elements such as photo-diodes or photo-transistors.

Ultrasonic emitting elements may be used as the energy beam emitting elements to emit ultrasonic beam.

The semiconductor light emitting elements (LED's or LD's) and the ultrasonic emitting elements are suitable for the abnormal vibration sensors 97, because that can emit a directional beam with narrow emitting angle.

The energy beam emitting elements of the abnormal vibration sensors 97 emit always light beam or ultrasonic beam toward running surfaces of the rails 15 and the energy beam receiving elements receive the light beam or ultrasonic beam reflected from the running surfaces of the rails 15.

Light beam or ultrasonic beam from the energy beam emitting elements is preferably modulated to avoid noise from an environment.

The energy beam receiving elements receive always a reflected signal from the running surfaces of the rails 15 and the control circuit device 99 analyzes the reflected signal.

The control circuit device 99 judges whether a displacement (a lateral displacement "d" or a vertical displacement "h" as shown in FIG. 31 and FIG. 32) of the bogie 13 or the wheels 10 is within an allowable range or exceeds the allowable range.

In FIGS. 31 and 32, for example, if the control circuit device 99 compares the reflected signal in four points and judges that the displacement exceeds the allowable range for safe running zone of a height allowance "h" and a wide allowance "d", the control circuit device 99 controls to release the rock device 93 and the wheel guiding device is driven.

When the rock device 93 is released, the cylindrical member 92 is descended quickly by a restoring power of the coil spring 90 and a weight of the cylindrical member 92.

According to descending of the cylindrical member 92, the wheel guiding member 22 having two inclined surfaces fixed to the bottom terminal of the cylindrical member 92 is descended.

According to descending of the wheel guiding member 22, the two inclined surfaces come in contact with the rail 15 and the wheel 10 is guided to a normal running surface so that the bogie 13 and a rolling stock are protected from a derailment.

At the same time, the bogie 13 and the rolling stock decrease the speed or stop due to a friction power of contact between the inclines surfaces and the rail A Sixth Embodiment of the Invention Referring to FIG. 34, a sixth embodiment of the invention is described below.

Figure 34:
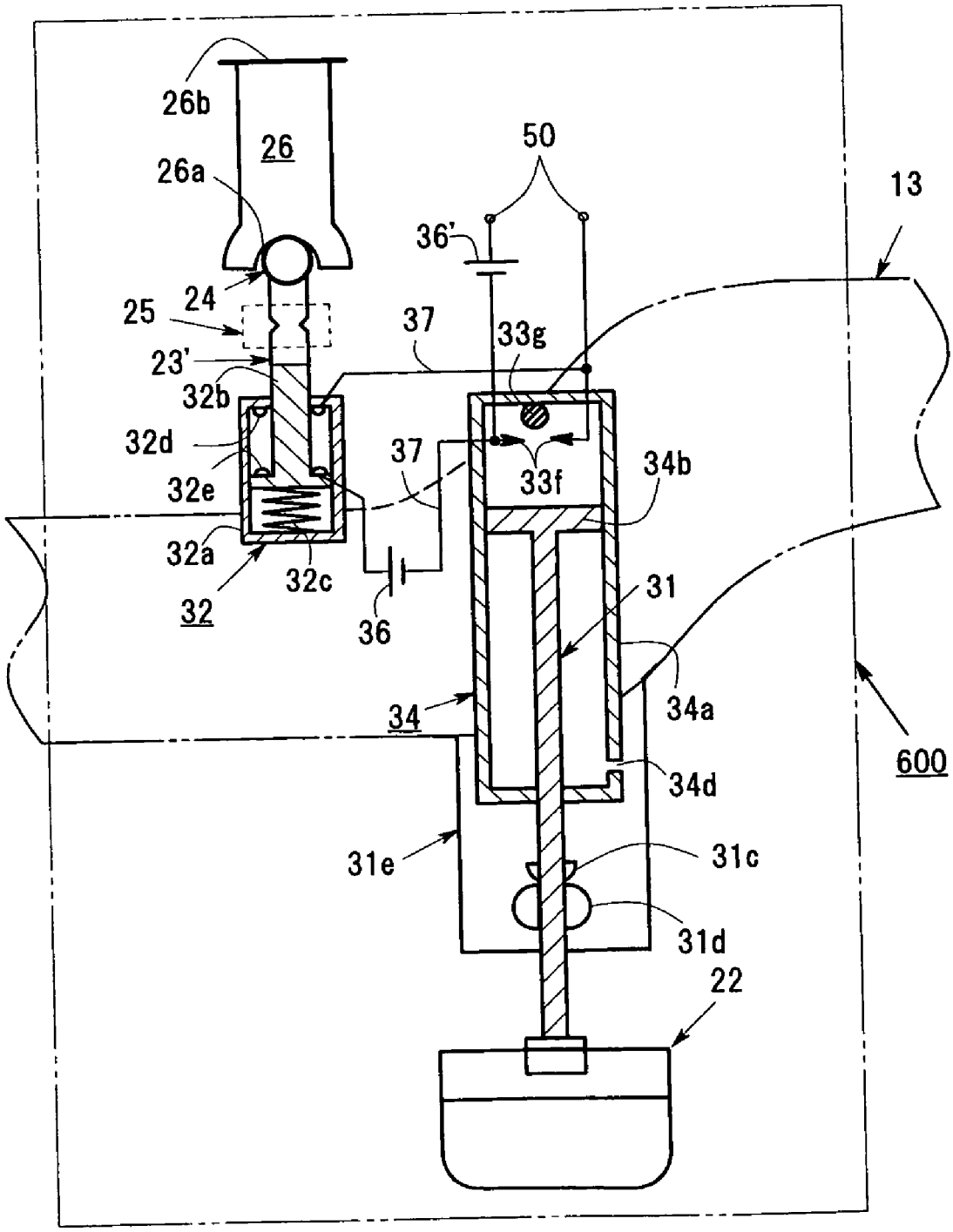
FIG. 34 is a schematic elevational view of the derailment protection apparatus according to the sixth embodiment of the invention.

FIG. 34 is a schematic elevational view showing a derailment protection apparatus 600 according to the sixth embodiment of the invention.

As shown in FIG. 34, the derailment protection apparatus 600 may be composed of an abnormal vibration response means 25 and 32 and a wheel guiding device.

The abnormal vibration response means may be composed of a vibration breaker 25 and a vibration sensor 32.

The wheel guiding device is composed of a gas cylinder 34 fixed on the bogie 13, a movable vertical shaft 31 and the wheel guiding member (rail contact member) 22 fixed to a lower end of the vertical shaft 31.

The wheel guiding device is further composed of a pair of discharge electrodes 33*f* positioned inside an upper portion of the gas cylinder 34 and an explosive 33*g* enclosed adjacent to the discharge electrodes 33*f* inside of the gas cylinder 34.

The movable vertical shaft 31 is acting as a supporting member of the wheel guiding member (rail contact member) 22.

When the shock breaker 25 is broken by an abnormal vibration, the electric contacts 32*d* and 32*e* are closed so as to supply an electric current from a high voltage power supply 36 to the discharge electrodes 33*f* through an electric wiring 37 so that an electric spark generates.

When the explosive 33*g* within the gas cylinder 34 is exploded by the electric spark, the movable shaft 31 and the wheel guiding member 22 is descended quickly.

Instead of the shock breaker 25, the movable shaft 31 and the wheel guiding member 22 may be activated by a human judgment of a car driver or a conductor.

When the car driver or the conductor operates a switch (70*a*, 70"*a* or 70*b*) in the driver's cab 11*a* or the conductor's room 11*b* as shown in FIG. 21, another high voltage power supply 36' supplies a high voltage to the discharge electrodes 33*f* to generate the electric spark through the electric wiring 50.

It is noted that the abnormal vibration detecting device having the abnormal vibration sensors 97 (97A, 97 B, 97C and 97D) and the control circuit 99 to control wheel guiding devices 90, 91, 92, 93 and 22 mentioned in the fifth embodiment can be used instead of the abnormal vibration responsive devices in other derailment protection apparatuses 200, 300, 400 and 600 or the abnormal vibration detecting device 97 and 99 in the fifth embodiment can be used together with the abnormal vibration responsive devices in other derailment protection apparatuses 200, 300, 400 and 600.

In the embodiment as shown in FIG. 19, a rack and pinion mechanism is used as a wheel guiding member ascending device to ascend again the wheel guiding member to an original position after the wheel guiding member descended.

Other wheel guiding member ascending device may be used instead of the rack and pinion mechanism.

Figure 33:
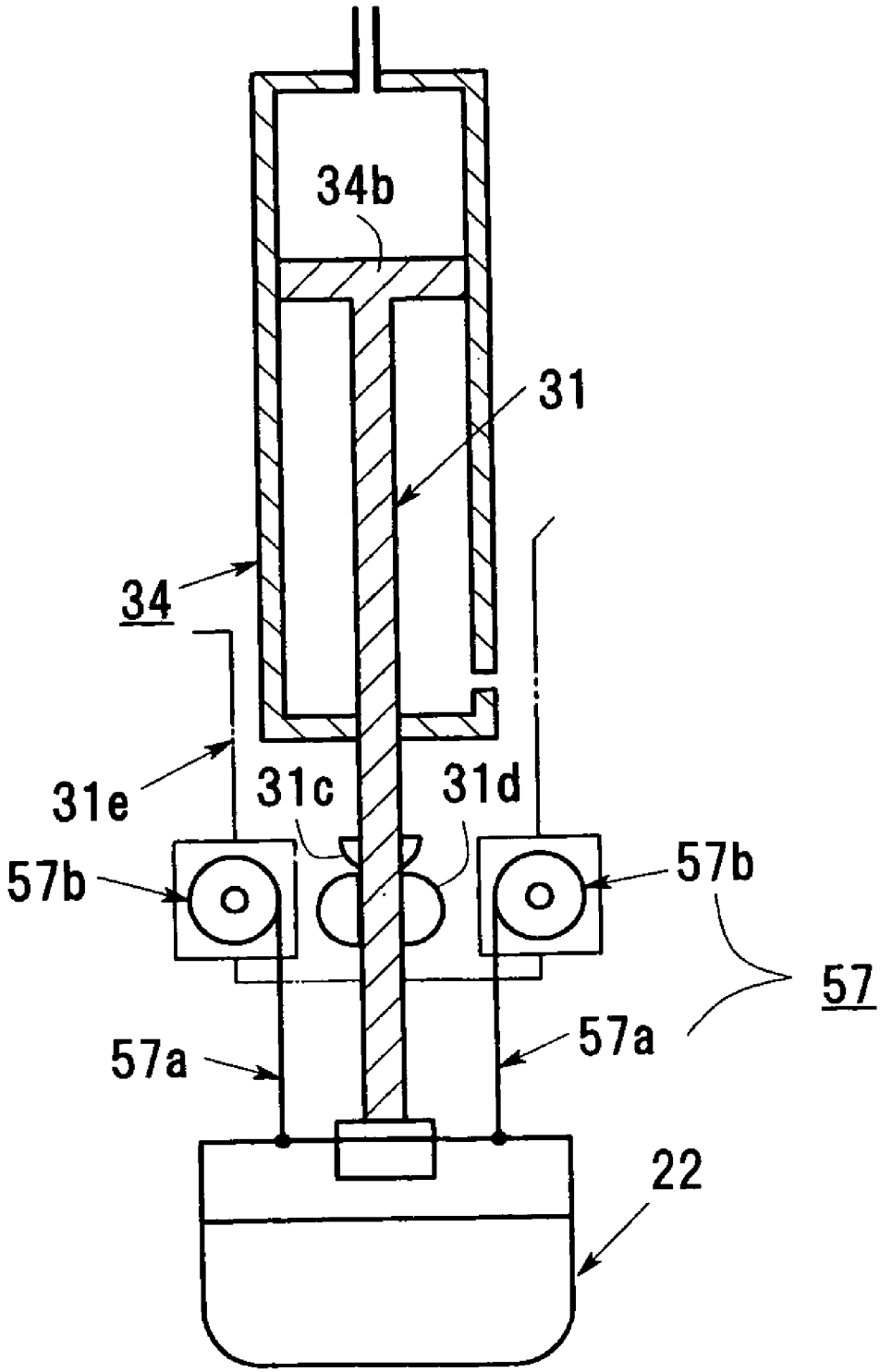
FIG. 33 is a schematic elevational view of other wheel guiding member ascending device.

As shown in FIG. 33, for example, the wheel guiding member ascending device 57 is composed of a flexible wire 57*a* and a rotate-able reel 57*b*.

The flexible wire 57*a* is fixed to an upper portion of the wheel guiding member 22 at that one end and fixed to the rotate-able reel 57*b* at another end.

The rotate-able reel 57*b* is fixed on the bogie through the fixing plate 31*e*.

The rotate-able reel 57*b* can be driven manually or by the motor.

The motor is fixed on the bogie through the fixing plate 31*e*.

When the rotate-able reel 57*b* is rotated manually or by the motor, the flexible wire 57*a* is wound inside the rotate-able reel 57*b*, the wheel guiding member 22 and a supporting member (shaft) 31 to support the wheel guiding member 22 can be ascended to the original position.

Although illustrative embodiments of the present invention have been described referring to the accompanying drawings, it is to be understood that the present invention is not limited to those embodiments and that various changes, modifications or equivalents may be made in the present invention by those skilled in the art without departing from the spirit or the scope of the present invention and the appended claims.

What is claimed is:

1. A railroad safety apparatus installed on a railroad car or bogie comprising:

a wheel guiding member having a rail contact surface;

a descending device to descend the wheel guiding member, wherein the rail contact surface comes in contact with a rail, when the descending device operates;

wherein the descending device further comprises at least one lock device;

wherein the at least one lock device keeps the wheel guiding member at a first predetermined position in a normal state; and wherein the at least one lock device keeps the wheel guiding member at a second predetermined position lower than the first predetermined position, in a abnormal state when a mechanical force more than a predetermined allowable range is applied to the railroad car or bogie.

2. The railroad safety apparatus according to claim 1: wherein the descending device is controlled by a human judgment or by an abnormal vibration detecting device to detect an abnormal vibration; and thereby the descending device is activated.

3. The railroad safety apparatus according to claim 1: wherein the wheel guiding device having a supporting member to support the wheel guiding member at one terminal and to be movably fixed on a bogie.

4. The railroad safety apparatus according to claim 1, further comprising: a wheel guiding member ascending device to ascend the wheel guiding member from a descended position to an original position.

5. The railroad safety apparatus according to claim 1, further comprising: a wheel guiding member ascending device to ascend the wheel guiding member from a descended position to an original position; and wherein wheel guiding member ascending device comprises a rack and pinion mechanism or a flexible wire winding mechanism.

6. The railroad safety apparatus according to claim 1, further comprising: at least one vibration sensor having an emitting element to emit an energy beam directed to a rail and a receiving element to detect a reflected beam; a control circuit to connect electrically to the vibration sensor; and wherein the control circuit controls the wheel guiding device to analyze an abnormal state of a derailment.

7. The railroad safety apparatus according to claim 1, further comprising: an explosive; and wherein the wheel guiding member is descended when the explosive explodes.

8. The railroad safety apparatus according to claim 1, further comprising: a gas cylinder fixed on a bogie having a movable shaft and an explosive enclosed in the gas cylinder; wherein the wheel guiding member is fixed to a lower terminal of the movable shaft; and wherein the movable shaft is descended by an explosion of the explosive.

9. The derailment protection apparatus according to claim 1: the descending device further comprising a combination of a rack and pinion mechanism.

10. A derailment protection apparatus comprising:

a wheel guiding device comprising a wheel guiding member having a rail contact surface;

a descending device to descend the wheel guiding member;

the descending device further comprising: a rotary member having a rotary axis fixed on a bogie; a support member fixed on the rotary member elongated to the wheel guiding member; and a rod member connected to the rotary member elongated to a flexible joint member; and wherein the rotary member rotates in an abnormal state so that the wheel guiding member is descended to the functioning position and the rail contact surface comes in contact with a rail.

11. The derailment protection apparatus according to claim 10, the rotary member further comprising at least one spring fixed on a bogie at one end.

12. A derailment protection apparatus comprising:

a wheel guiding device comprising a wheel guiding member having a rail contact surface;

a descending device to descend the wheel guiding member, comprising: (a) a fluidic cylinder fixed on a bogie having a shaft actuated by compressed fluid; (b) a compressed fluid tank fixed on the bogie to supply the compressed fluid to the fluidic cylinder, wherein the wheel guiding member is fixed on a bottom end of the shaft; and wherein the descending device further comprises: (c) at least one stopper fixed on the shaft; and (d) at least one lock device fixed on the bogie.

13. A derailment protection apparatus comprising:

a wheel guiding device comprising a wheel guiding member having a rail contact surface;

a descending device comprising a spring member and at least one lock device;

wherein the at least one lock device locks the spring member to keep a compressed state in a normal state: and wherein the at least one lock device unlocks the spring member to release the compressed state in an abnormal state so as to descend the wheel guiding member.

14. A derailment protection apparatus comprising:

an abnormal vibration responsive device to detect an abnormal vibration more than a predetermined allowable range;

a wheel guiding device having a wheel guiding member with an inclined surface; wherein the inclined surface is descended to a functioning position to come in contact with a rail and the inclined surface guides a wheel to return on the rail;

the wheel guiding device further comprising: a cylindrical member; a tubular member fixed on a bogie movably to guide the cylindrical member, a coil spring positioned around the cylindrical member; and at least one lock device to lock the cylindrical member to keep an upper position in a normal state;

wherein the wheel guiding member is fixed to a lower portion of the cylindrical member; and wherein, in an abnormal state, the lock device releases the cylindrical member to descend the cylindrical member.

15. The derailment protection apparatus according to claim 14, wherein the abnormal vibration responsive device comprises a shock breaker having a mechanically weak portion.

16. The derailment protection apparatus according to claim 14, the abnormal vibration responsive device further comprising: a first rod member having a first flexible joint; a second rod member fixed to a car body having a second flexible joint; and wherein the first flexible joint and the second flexible joint are movably coupled together.

17. A derailment protection apparatus comprising:

an abnormal vibration responsive device to detect an abnormal vibration more than a predetermined allowable range;

a wheel guiding device having a wheel guiding member with an inclined surface; and wherein the inclined surface is descended to a functioning position to come in contact with a rail and the inclined surface guides a wheel to return on the rail:

the wheel guiding device further comprising: a rotary member having a rotary axis fixed on a bogie; a support member fixed on the rotary member elongated to the wheel guiding member; and a rod member connected to the rotary member and elongated to a flexible joint member; and wherein the rotary member rotates in an abnormal state so that the wheel guiding member is descended to the functioning position.

18. The derailment protection apparatus according to claim 17, wherein the abnormal vibration responsive device comprises a shock breaker having a mechanically weak portion.

19. The derailment protection apparatus according to claim 17, the abnormal vibration responsive device further comprising: a first rod member having a first flexible joint; a second rod member fixed to a car body having a second flexible joint; and wherein the first flexible joint and the second flexible joint are movably coupled together.

20. The derailment protection apparatus according to claim 17, the rotary member further comprising at least one spring fixed on a bogie at one end.

21. A derailment protection apparatus comprising:

an abnormal vibration responsive device to detect an abnormal vibration more than a predetermined allowable range;

a wheel guiding device comprising a wheel guiding member having an inclined surface;

a descending device to descend the wheel guiding member, comprising: (a) a fluidic cylinder fixed on a bogie having a shaft actuated by compressed fluid; (b) a compressed fluid tank fixed on the bogie to supply the compressed fluid to the fluidic cylinder, wherein the wheel guiding member is fixed on a bottom end of the shaft; and wherein the descending device further comprises: (c) at least one stopper fixed on the shaft; and (d) at least one lock device fixed on the bogie.

22. The derailment protection apparatus according to claim 21, wherein the abnormal vibration responsive device comprises a shock breaker having a mechanically weak portion.

23. The derailment protection apparatus according to claim 21, the abnormal vibration responsive device further comprising: a first rod member having a first flexible joint; a second rod member fixed to a car body having a second flexible joint; and wherein the first flexible joint and the second flexible joint are movably coupled together.

24. A wheel guiding device, installed on a railroad car or bogie for use in a railroad safety apparatus comprising:

a first wheel guiding member (22) composed of a first rail contact surface (FC) having an inclined surface with a rectangular flat shape as a whole; and wherein the first rail contact surface (FC) comes in contact with a side surface of a rail, when the first wheel guiding member (22) descends in an abnormal state when a mechanical force more than a predetermined allowable range is applied to the railroad car or bogie;

the wheel guiding device further comprising:

a second wheel guiding member (40) protruded from an upper portion of the first wheel guiding member (22);

wherein the second wheel guiding member (40) comprises a third rail contact surface having a downwardly curved surface (FG); and wherein the second rail contact surface comes in contact with a running surface or the side surface of the rail in the abnormal state.

25. A wheel guiding device, installed on a railroad car or bogie for use in a railroad safety apparatus comprising:

a first wheel guiding member (22) composed of a first rail contact surface (FC) having an inclined surface with a rectangular flat shape as a whole; and wherein the first rail contact surface (FC) comes in contact with a side surface of a rail, when the first wheel guiding member (22) descends in an abnormal state when a mechanical force more than a predetermined allowable range is applied to the railroad car or bogie;

the wheel guiding device further comprising:

a second wheel guiding member (40, 80) protruded from an upper portion of the first wheel guiding member (22);

wherein the second wheel guiding member (40, 80) comprises a second rail contact surface having a flat surface (40*d*) or an upwardly curved surface;

wherein the second rail contact surface comes in contact with a running surface of the rail in the abnormal state;

the second wheel guiding member, further comprising:

at least one roller (82) is positioned in/on the second rail contact surface; and wherein the at least one roller (82) is protruded from the second rail contact surface;

the second wheel guiding member, further comprising:

at least one roller (82) is positioned in/on the second rail contact surface; and wherein the at least one roller (82) is protruded from the second rail contact surface.

26. The wheel guiding device according to claim 25, wherein the at least one roller (82) has a substantially conical shape.

* * * * *